US006371718B1

(12) United States Patent
Foster et al.

(10) Patent No.: US 6,371,718 B1
(45) Date of Patent: Apr. 16, 2002

(54) MATERIALS HANDLING DEVICE

(75) Inventors: Harry L. Foster, Jefferson Hills; Gerald R. Holman, Wexford; Alan J. Mirarchi, Pittsburgh; Roger M. Payne, Sewickley, all of PA (US)

(73) Assignee: Keywell, L.L.C., Chicago, IL (US)

( * ) Notice: Subject to any disclaimer, the term of this patent is extended or adjusted under 35 U.S.C. 154(b) by 0 days.

(21) Appl. No.: 09/344,532

(22) Filed: Jun. 25, 1999

(51) Int. Cl.[7] ..... B66C 3/02
(52) U.S. Cl. ..... 414/421; 294/68.26; 414/425
(58) Field of Search ..... 294/68.26, 68.27; 414/192, 303, 397, 404, 421, 425; 206/506

(56) References Cited

U.S. PATENT DOCUMENTS

| | | | | | |
|---|---|---|---|---|---|
| 32,151 | A | | 4/1861 | Shepherd | |
| 42,439 | A | | 4/1864 | Jones | |
| 235,681 | A | | 12/1880 | Histed | |
| 959,096 | A | | 5/1910 | Zoller | |
| 1,055,524 | A | | 3/1913 | Edison | |
| 2,289,024 | A | | 7/1942 | Lambert | |
| 2,417,121 | A | | 3/1947 | Nelson | |
| 2,690,277 | A | | 9/1954 | Shea et al. | |
| 2,833,586 | A | * | 5/1958 | McFeaters | 294/68.26 |
| 3,230,003 | A | * | 1/1966 | McAfoos, Jr. et al. | 294/68.27 |
| 3,374,907 | A | * | 3/1968 | Phillips et al. | 294/68.27 |
| 3,421,640 | A | * | 1/1969 | Falk | 414/192 |
| 3,489,299 | A | * | 1/1970 | Smith | 294/68.27 |
| 3,502,233 | A | * | 3/1970 | Mevissen et al. | 414/421 |
| 3,589,692 | A | * | 6/1971 | Lakin | 414/192 |
| 3,606,438 | A | * | 9/1971 | Feczko | 294/68.27 |
| 3,827,583 | A | * | 8/1974 | Enkner | 414/192 |
| 5,641,188 | A | * | 6/1997 | Phillips | 294/68.26 |

FOREIGN PATENT DOCUMENTS

| | | | | |
|---|---|---|---|---|
| DE | 62000 | * | 5/1968 | 294/68.26 |
| GB | 124615 | | 4/1919 | |
| WO | 86/00606 | * | 1/1986 | 294/68.26 |

* cited by examiner

*Primary Examiner*—James W. Keenan
(74) *Attorney, Agent, or Firm*—DKW Law Group, P.C.

(57) ABSTRACT

The present invention relates generally to improved materials handling devices, and more particularly, to containers into which materials are easily loaded and unloaded and which provide for the efficient storage and transportation of the materials deposited therein. The present invention is also directed to unloading facilities associated with the containers which facilitate the removal of the materials deposited in the containers from such containers. The present invention is particularly well suited to provide a materials handling device for storing and transporting scrap metals, which materials handling device includes a container into which, and from which, the scrap metal is easily loaded and unloaded.

43 Claims, 13 Drawing Sheets

MATERIALS HANDLING DEVICE

BACKGROUND OF THE INVENTION

1. Field of the Invention

The present invention relates generally to improved materials handling devices, and more particularly, to containers into which materials are easily loaded and unloaded and which provide for the efficient storage and transportation of the materials deposited therein. The present invention is also directed to unloading facilities associated with the containers which facilitate the removal of the materials deposited in the containers from such containers. The present invention is particularly well suited to provide a materials handling device for storing and transporting scrap metals, which materials handling device includes a container into which and from which the scrap metal is easily loaded and unloaded.

2. Description of Prior Art

In virtually every industrial process, raw materials are combined or otherwise manipulated to form a finished product. In many cases, the raw materials are stored in bulk and then subdivided into smaller shippable quantities. The smaller quantities may then either be used directly or further subdivided into even smaller quantities by a manufacturer.

For example, scrap iron is typically recycled by steel mills by collecting and remelting it for use in new products. The individual pieces of scrap iron are generally of many different weights and sizes and are commonly collected by scrap metal dealers in scrap yards. The scrap metal is often sorted in the scrap yard by placing the scrap metals in piles of related materials. The materials may be related, for example, by metallic composition (e.g., aluminum, steel, copper, etc.) by size of individual scrap pieces or other criteria. After sufficient scrap metal has been accumulated, the piles of scrap metal are loaded into containers for transportation to a steel mill for remelting and use in producing new steel materials.

The container into which the scrap is loaded for transportation from the scrap yard to the steel mill may be, for example, a railroad car or the bed of a truck. Also, by way of example, the container may be a shipping container, which shipping container is then in turn loaded generally by using a crane into a railroad car or onto the bed of a truck.

Generally, the scrap metal is loaded into the container by grasping the scrap metal with one or more conventional crane-operated grappling hooks and then positioning the grappling hook over the container and opening the hook to cause the scrap metal to fall into the container. The container is then transported to a steel mill where the scrap metal is unloaded, typically by a similar grappling hook method.

More particularly, in the typical unloading process, there is provided at the steel mill a scrap metal unloading station or area where the container of scrap metal may be unloaded. In the unloading area, there is generally provided one or more cranes which are fitted with one or more grappling hooks. The scrap metal in the container is seized by the crane-operated grappling hook, which hook is lifted from the container by the crane and is then positioned over yet another container commonly referred to as a "charge bucket". The hook is then released causing the scrap metal to fall into the charge bucket.

The function of the charge bucket is to collect the scrap metal, transport it into the steel mill and transfer the scrap metal from the charge bucket into a melting furnace where the scrap metal can be melted and used in producing new steel products. Conventional charge buckets typically hold about 150,000 to 200,000 pounds of scrap metal and are located on transfer cars. The transfer cars are wheeled platforms that travel on rails to permit the charge bucket to be easily moved from the unloading area to the melting furnace. The transfer car having the charge bucket disposed thereon is then pulled or pushed into the steel mill meltshop where its contents are deposited into one or more furnaces and melted.

The grappling method of unloading the container has significant limitations. For example, unloading the container by the grappling method is a slow process and requires a relatively large amount of time. Also, for example, pieces of scrap metal may move or shift positions during the transportation to the steel mill interfering with the grappling operation and requiring hand effort or other machinery to aid in the unloading operation. Still further, near the end of the unloading process it becomes increasingly difficult to grapple the remaining scrap metal requiring hand effort or other machinery to aid in the completion of the unloading operation. Finally, scrap metal has a tendency to fall from the grappling hook as the scrap metal is transported from the container to the charge bucket, creating a safety hazard and requiring still further hand effort or machinery to keep the unloading area free of fallen scrap metal pieces.

A presently available improvement to this conventional grappling hook-based scrap metal loading and unloading system utilizes a self-dumping container as illustrated in FIGS. 1A and 1B and discussed in more detail below.

In FIG. 1A there is shown an unloading station 10 where scrap metal from a container 12 is unloaded into a charge bucket 14. Containers of the type of container 12 generally hold about 10,000 pounds of scrap metal. The scrap metal is typically loaded into the container 12 at the scrap metal yard using either the grappling hook-based system described above for pieces of scrap large enough to be grappled or by other methods, such as by hand or with a utility tractor equipped with a bucket for pieces of scrap metal too small or otherwise not suitable for grappling.

The container 12 is unloaded into the charge bucket 14 at the steel mill in the fashion described below. The charge bucket 14 used in this improved system is typically cylindrical having an open top 16 and a flat bottom. The charge bucket 14 is disposed over a transfer car 18, which transfer car 18 includes a plurality of wheels 19 which ride along a pair of rails 20 to allow the charge bucket 14 to be moved between the unloading station 10 and the melt furnace in the steel mill. A planar stage or platform 22 is located near the top of the charge bucket 14 and extends inwardly toward a center 24 of the charge bucket 14. As illustrated in FIG. 1, in some charge buckets 14, the planar stage 22 is not present and a simple bar 23 extends across a portion of the charge bucket 14, and the container 12 rests on the bar 23 and a lip 25 of the charge bucket 14. The container 12 used in this improved system is generally rectangular and includes a planar bottom 26, two opposed side walls 28 and 29, a front wall 30, a rear wall 32 and an open top 34. A bale assembly 40 is mounted on the side walls 28 and 29 of the container 12. The bale assembly 40 includes a movable bale 42 mounted between two complicated locking devices 44 on either side of the container 12. The locking devices 44 permit the bale 42 to be maintained in either a nearly vertical locked position, shown in dashed lines in FIG. 1A of the drawings, in which pivotal rotation of the bale 42 relative to the container 12 is prevented or in a pivotal position, shown in solid lines in FIG. 1A of the drawings, in which the bale 42 and container 12 are free to pivot relative to one another.

Even in its lowest pivotal position, a portion of the bale 42 still extends above the open top 34 of the container 12 as illustrated in FIG. 1A.

In normal operation, the container 12 is filled with scrap metal at the scrap yard. The container 12 is then hoisted onto a transportation means, such as a railcar or truck bed by a crane. During this hoisting operation, the bale 42 is in its locked position to prevent any pivotal movement of the bale 42 relative to the container 12 thereby preventing the container 12 from pivoting and unintentionally permitting the scrap metal to fall out of the container 12 during the hoisting operation. As the container 12 is placed into the railcar or on the truck bed or other transportation device and the crane no longer provides upward force on the bale 42, the bale 42 is released by the locking mechanisms 44 into its pivotal position.

When the container 12 arrives at the steel mill, a crane is attached to the bale 42 to lift the container 12. The upward force of the crane causes the bale 42 to return to its vertical locked position permitting the container 12 to be transported from the transportation device (e.g., out of a railcar) and onto the platform 22 (or the bar 23 and lip 25 as illustrated in FIG. 1B) without pivotal rotation of the bale 42 relative to the container 12. After the container 12 has been placed on the platform 22, the upward force of the crane is released and the complex locking mechanisms 44 release permitting the bale 42 to return to its pivotal position and remain in that position until the container 12 is again raised by bale 42 by the crane. The crane is then used to move and pivotally rotate the container 12 about the platform 22 (or the bar 23 and lip 25 illustrated in FIG. 1B) to cause the scrap metal to fall from the container 12 into the charge bucket 14.

There are, however, problems associated with this improved unloading system. For example, the locking devices 44, typically ratchet gear boxes, are complex mechanisms that must be activated by lifting the container 12. The mechanisms of the locking devices 44 often stick due to wear or the build up of pieces of scrap metal in the locking devices which requires physically shaking the container 12. This presents a safety hazard to the workers in the immediate vicinity of the unloading operation and causes delays in the unloading process. Moreover, attached to a crane, the container 12 is analogous to a free floating pendulum making it difficult to place the container 12 on the platform 22 (or the bar 23 and lip 25 illustrated in FIG. 1B), making it difficult to control the movement of the container 12 during dumping, and making difficult to accurately dump the scrap metal pieces into the charge bucket 14. Therefore, the container 12 must be handled slowly and with great care so as not to cause personal injury or property damage. Moreover, because a portion of the bale 42 extends above the open top 34 of the container 12 even when the bale 42 is in its lower pivotal position, stacking several containers 12 on top of one another for storage or transportation, whether empty or full of scrap metal, is not possible. This reduces shipping efficiency when using the container 12 to transport scrap metal in the container 12 to the steel mill. For example, because the shipping containers 12 are not stackable, it is not possible to provide a railroad car full of self-dumping containers 12. Rather, a railroad car is typically loaded with scrap by the grappling hook method until nearly full, whereupon a few containers of the type of container 12 are placed on top of the scrap metal already loaded into the railroad car. This arrangement results in an undesirable loss of transportation space in the railroad car. An additional drawback of the above-described system is that scrap metal pieces may be inadvertently dumped onto the platform 22 interfering with the setting of the container 12 on the platform 22. Further, pieces of scrap metal tend to miss the open top 16 of the charge bucket 14 during the unloading process and tend to fall around the base of the charge bucket 14 creating an additional safety hazard.

As may be appreciated by the foregoing, there remains a need in the art for a materials handling device which is simple to manufacture and operate which avoids the use of complex locking devices or mechanism and which permits the safe and sure unloading of its contents into a repository. It would also be advantageous to provide a material handling device which is easily and efficiently transported, as for example, by providing materials handling devices that are stackable upon one another.

SUMMARY OF THE INVENTION

It is an object of the present invention to provide a materials handling device which is simple to manufacture and operate.

It is also an object of the present invention to provide a materials handling device which is easily and efficiently transported by providing materials handling devices which are stackable upon one another.

It is yet another object of the present invention to provide a materials handling device which permits the safe and sure unloading of its contents into a repository.

These and other objects are obtained with the present invention which is directed to a materials handling device which includes:

- a container comprising a floor and a pair of opposed side walls affixed to the floor to form a structure for receiving materials therein, the container having an open top;
- a bale having a first and second end, the bale being pivotally affixed to one of the pair of opposed side walls at its first end and pivotally affixed to the other of the side walls at its second end, wherein the bale provides a mechanism for lifting and moving the container; and
- a means for securing the container over a repository for the materials contained within the container, wherein the securing means secures the container over the repository such that the container may be pivotally rotated to cause the materials within the container to be deposited within the repository.

In one embodiment of the present invention, the securing means includes a means for pivotally rotating the container by pivotally rotating the bale and the container relative to one another.

In an alternative embodiment of the present invention, the securing means includes a hinged supporting device, and the container is pivotally rotated by placing the container on the hinged supporting device and rotating the supporting device about its hinge to pivotally rotate the container.

In a preferred embodiment of the present invention, the materials handling device of the present invention does not employ complex locking devices to prevent pivotal rotation of the bale relative to the container.

The materials handling device of the present invention is particularly well suited for transporting and unloading scrap metal.

A complete understanding of the invention will be obtained from the following description when taken in connection with the accompanying drawing figures, wherein like references numbers identify like parts throughout.

DETAILED DESCRIPTION OF THE PREFERRED EMBODIMENT

As used herein, the term scrap metal is not limiting to the invention in that it is not limited to any particular type of metal and the term scrap metal includes scrap iron, stainless steel scrap metal or other alloys. Further, while the present invention is described below in connection with the transportation and handling of scrap metal, as may be appreciated, the present invention is not limited to this application and may be used to handle or transport any type of material or materials.

Figure 2:
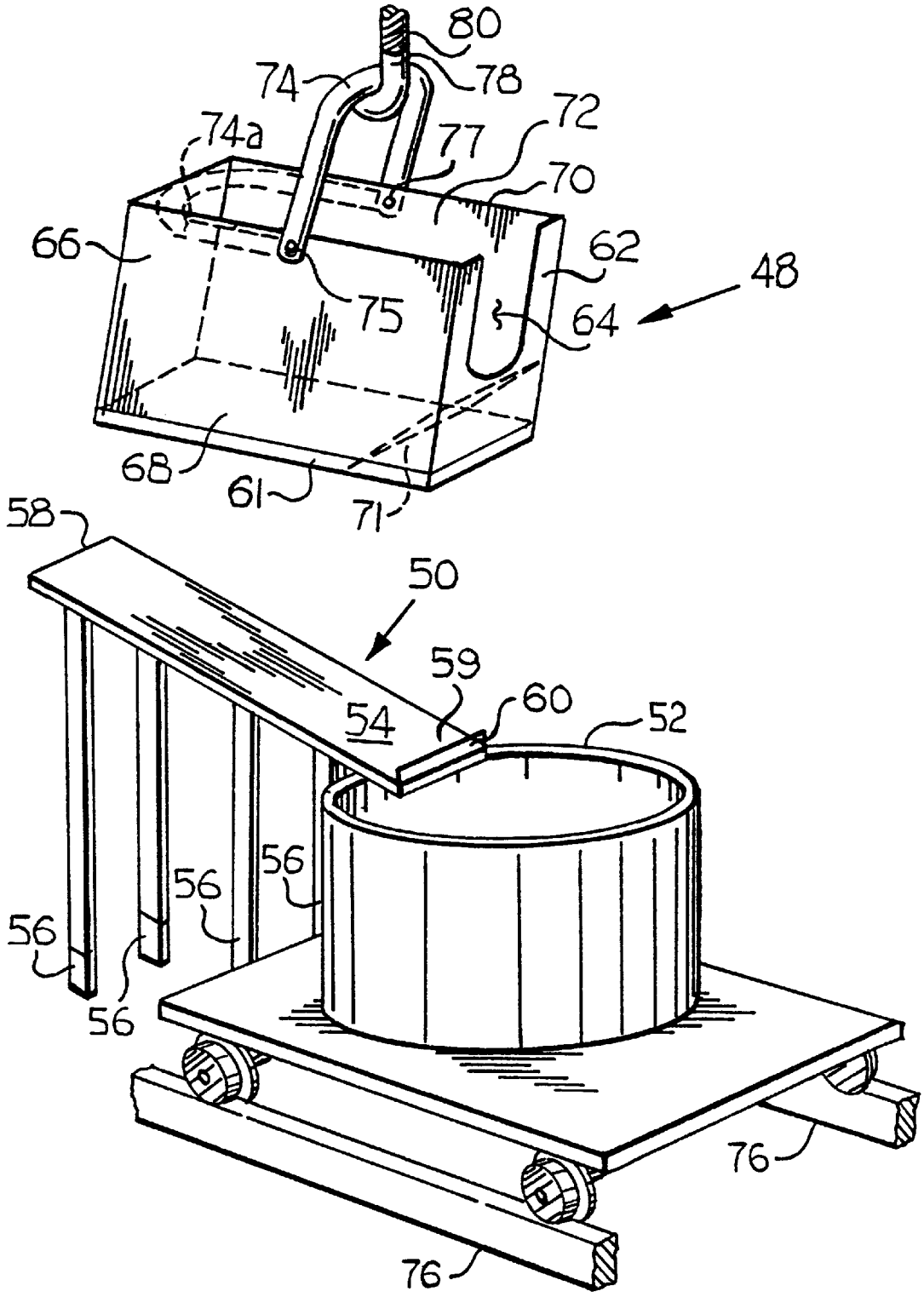
FIG. 2 is a side perspective view of a materials handling device in accordance with the present invention illustrating the use of a ramp assembly for unloading the contents of a container.

Referring now to FIG. 2, there is shown one embodiment of a materials handling device in accordance with the present invention. Illustrated in FIG. 2 are container 48 (e.g., a container of scrap metal) and unloading station 50 which cooperate in the manner described below to provide for the fast efficient and complete unloading of the contents of the container 48 into a repository (e.g., a charge bucket 52).

In this embodiment of the present invention, the unloading station 50 includes an inclined unloading slide or ramp 54 mounted on several supports 56. The supports 56 are not limiting to the present invention, but preferably are in the form of at least four legs or posts located at or near each corner of the ramp 54. The ramp 54 includes an upper end 58 and a lower end 59, with a stop 60 mounted on the lower end 59 of the ramp 54. The stop 60 is preferably a vertical wall, post or series of posts extending generally upwardly from the lower end 59 of the ramp 54. The height of the ramp 54 on the supports 56 is such that the lower end 59 of the ramp 54 is slightly above an open top of the repository when the repository is moved under the lower end 59 of the ramp 54. Hereinafter, the repository will be described as being a charge bucket 52, and the container 48 will be described as containing scrap metal, although as may be appreciated, and as stated above, the present invention is not limited to handling scrap metal but may be used to handle any suitable materials. Charge bucket 52 may be identical to charge bucket 12, illustrated in FIGS. 1A or 1B, but preferably does not include the platform 22. Other charge bucket modifications are contemplated as within the scope of the present invention to enable the charge bucket to function with the present invention. Certain of such other modified charge buckets are described below.

Container 48 includes a generally planar base or bottom plate 61, a front wall 62 having an optional opening 64 therein, a rear wall 66, a pair of opposed side walls 68 and 70 to form a generally box-like structure having an open top 72.

The precise shape of the opening 64 is not limiting to the present invention and may be of any shape including, but not limited to, square, rectangular or semicircular provided it is sufficiently large to enable the material inside the container 48 to easily flow through the opening 64 when the container 48 is being emptied as discussed in more detail below. The container 48 may also optionally include a ramp 71 illustrated in phantom in FIG. 2 to facilitate the flow of material out of the container 48 through the opening 64. Ramp 71 may be integrally formed with any or all of side walls 68 and 70, bottom plate 61 or front wall 62. In an alternative embodiment, ramp 71 may be removably attached to any or all of side walls 68 and 70, bottom plate 61 or front wall 62. Such removable attachment may employ any or all of the bolts, screws, rivets or other fasteners as are known in the art.

Figure 1A:
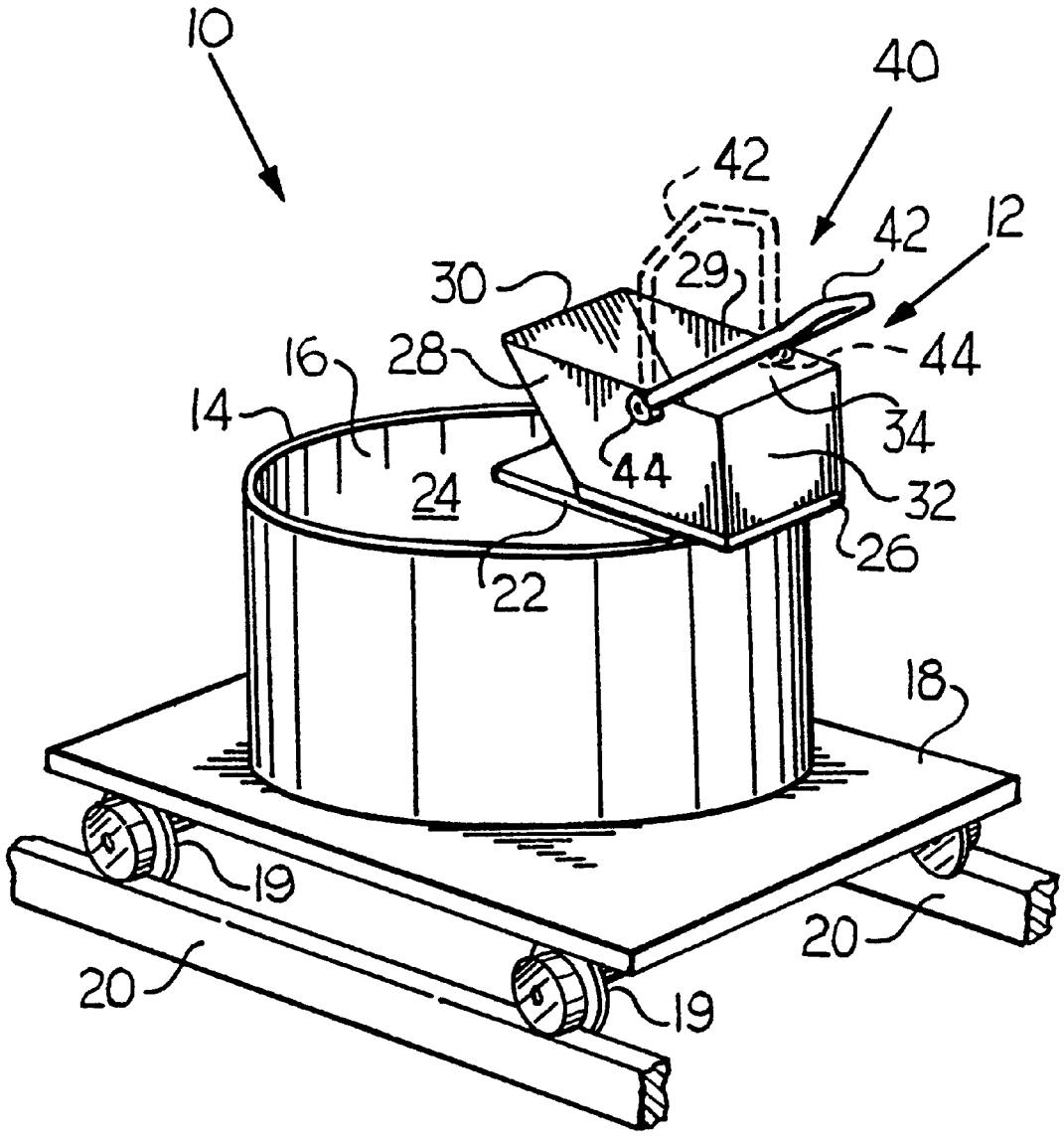
FIG. 1a PRIOR ART
FIGS. 1A and 1B are side perspective views of two presently available materials handling devices.
Figure 1B:
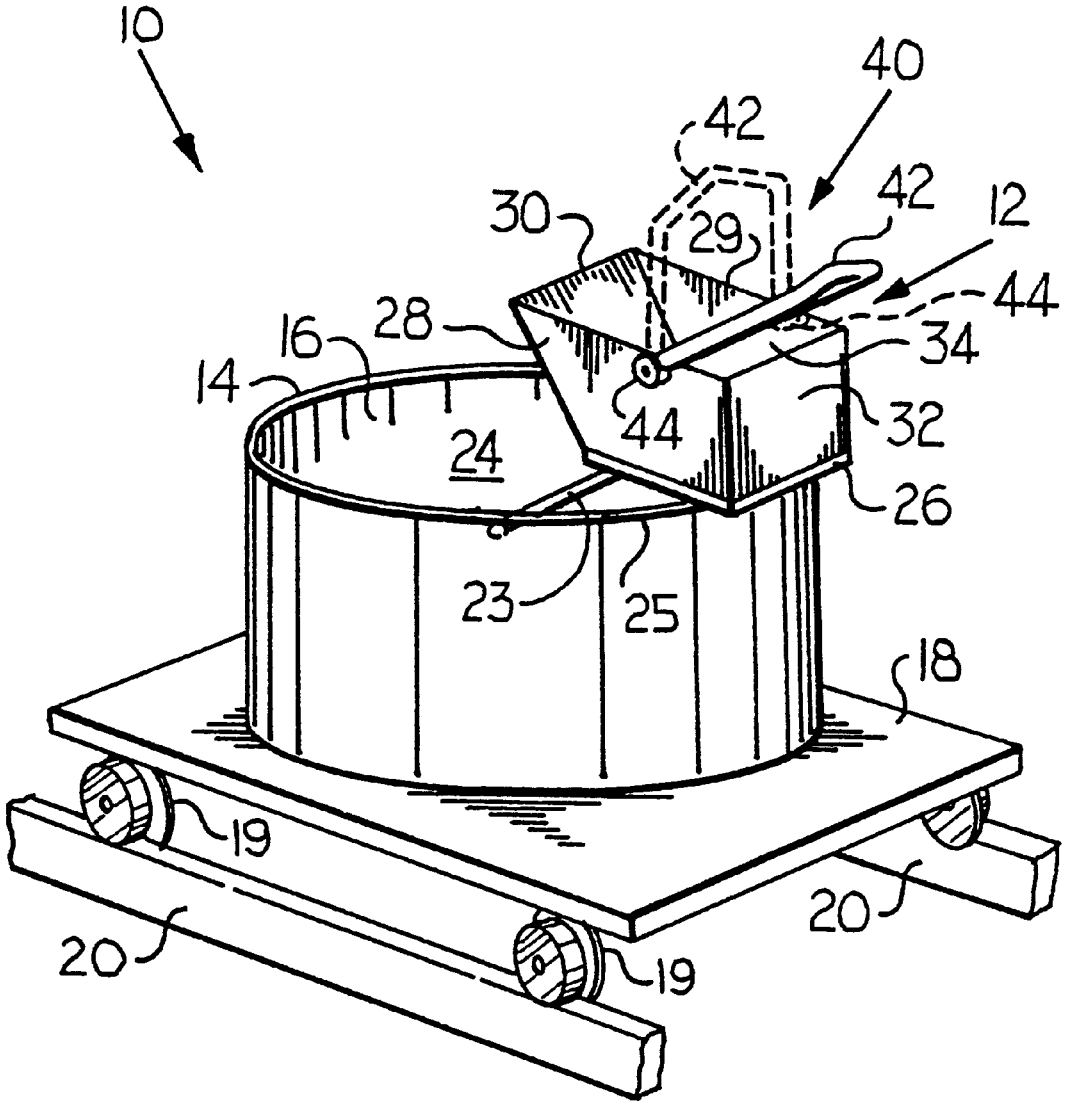
FIG. 1b PRIOR ART

In yet another embodiment (not shown), front wall 62 may be formed as a ramp having no opening therein in the same fashion as front wall 30 illustrated in FIGS. 1A and 1B, wherein the bottom plate 61, side walls 68 and 70 and rear wall 66 of container 48 form the same general shape as container 12 illustrated in FIGS. 1A and 1B.

In one embodiment of the present invention, container 48 includes a bale 74 pivotally mounted to the side walls 68 and 70 of the container 48. Preferably, the bale 74 is pivotally mounted to the side walls 68 and 70 of container 48 with a simple pivot and does not employ the use of complex locking mechanisms. For example, in one embodiment, bar members 75 and 77 extend externally of the interior surface of container 48 by extending perpendicular from the major plane of each of the side walls of the container 48 and the bale 74 includes apertures therein for receiving the bar members 75 and 77 permitting the bale 74 to pivot on the bar members 75 and 77 to permit the container 48 to pivot relative to the bale 74 as illustrated in FIG. 2. However, as may be appreciated, the precise design of the pivotal mounting of the bale 74 to the container 48 is not limiting to the invention provided it does not employ complex locking mechanisms and may include any simple pivot presently known or hereinafter developed. Preferably, the bale 74 is pivotally affixed to the side walls 68 and 70 such that it generally lies along a plane parallel with the top of the container 48 when the bale 74 is in its down or non-hoisting position as illustrated by the dashed lines of 74*a* in FIG. 2 to permit the containers 48 to be stably stacked upon one another in either a loaded or empty state. Where the pivot points are located near the top of the side walls 68 and 70, the bale 74 will be along a plane parallel with the top of the container 48. Where pivot points are located further down the side walls 68 and 70 (e.g., close to the base), the side walls 68 and 70 may require certain cut out portions (not shown) to prevent the bale 74 from extending above the side walls 68 and 70 when the bale 74 is in its down or non-hoisting position so that the containers 48 can be stably stacked upon one another in either a loaded or empty state.

Figure 4A:
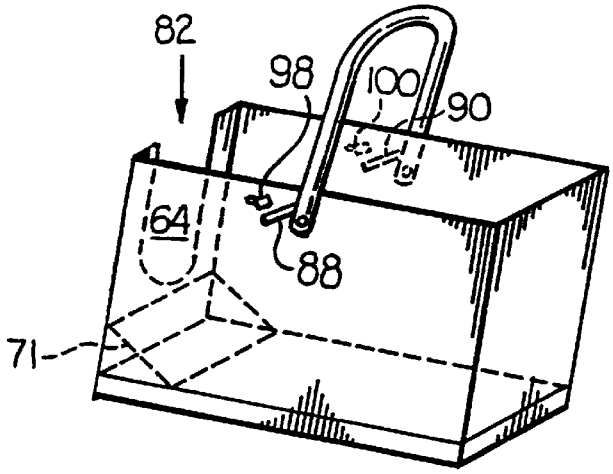
FIG. 4A is a side perspective view of a container in accordance with the present invention illustrating alternative placement of bale stops over that illustrated in FIG. 3.
Figure 4B:
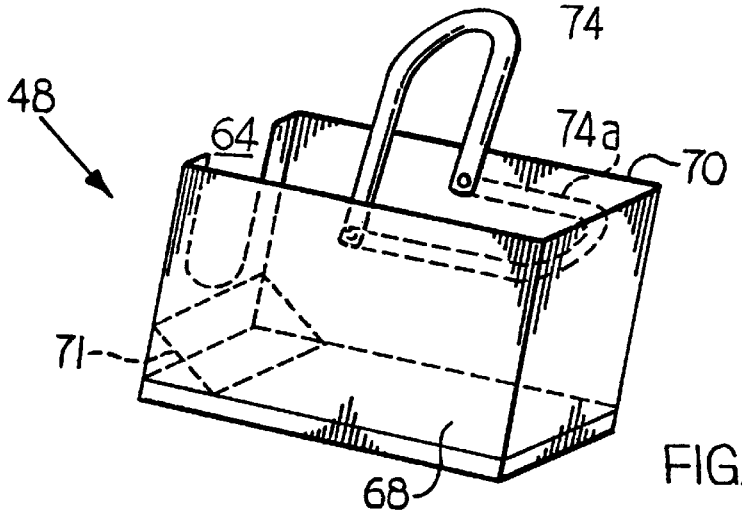
FIGS. 4B and 4C are side perspective views of an alternative embodiment of the materials handling device of the present invention illustrating alternative methods for pivotally affixing a bale to the container.

Further, while the bale 74 is illustrated in FIG. 2 as being pivotally mounted to the outside surfaces of the side walls 68 and 70 of container 48, as may be appreciated and as illustrated in FIG. 4B, the bale 74 may be pivotally mounted to the inside surfaces (e.g., those surfaces forming the inside of the box-like structure of container 48) of side walls 68 and 70. Where the bale 74 is pivotally mounted to the inside surfaces of the side walls 68 and 70 as illustrated in FIG. 4B, the bale 74 may lie in a plane parallel with but not extending upwardly beyond the top of the container 48 as illustrated in phantom by 74*a* in FIG. 4B. Not shown, is a stop or other device that, as may be appreciated, may be necessary to prevent the bale 74 from rotating downwardly into container 48 when in the down or non-hoisting position.

Figure 4C:
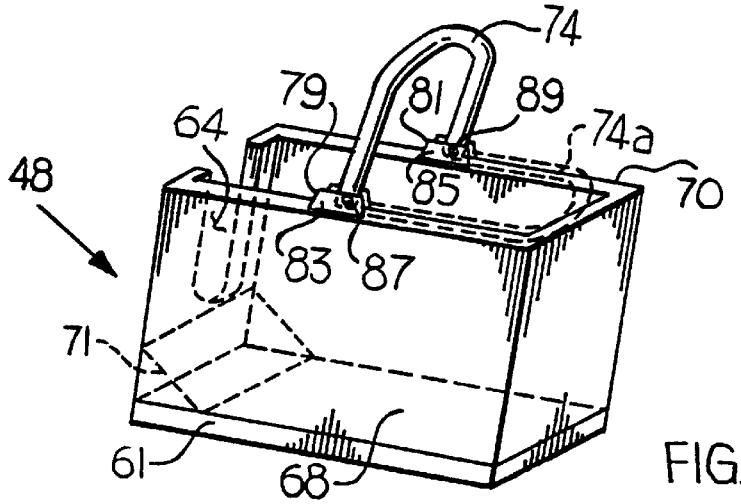

In yet another embodiment of the present invention, the bale 74 may be pivotally mounted to the top surface of the side walls 68 and 70 with pivotal mounting hardware 79 and 81 as illustrated in FIG. 4C. The pivotal mounting hardware 79 and 81 are not limiting to the present invention and may include any simple pivot. However, as illustrated in FIG. 4C, in one embodiment the pivotal hardware may include one or more plates 83 and 85 removably attached or integrally formed with the side walls 68 and 70, respectively, which plates include bar members 87 and 89 to form simple pivots for the hole 74 as described above. Where the bale 74 is pivotally mounted to the top surface of the side walls 68 and 70, it is preferred that the bottom plate 61 of the container 48 contain indentations (not shown) that correspond generally to the shape and placement of the pivotal mounting hardware 79 and 81 and/or the bale 74 such that a plurality of containers 48 can be stacked upon one another (not shown) with the mounting hardware 79 and 81 and/or bale 74 of the lower container 48 fitting into the corresponding indentations in the bottom plate 61 of the upper container 48 when two or more containers 48 are stacked upon each other. In this embodiment, the bale 74 may rest on top of the side walls when in its down or non-hoisting position as illustrated in phantom by 74*a* in FIG. 4C with a corresponding indentation in the top of side walls 68 and 70 corresponding to the shape of the bale 74 (not shown).

Referring now to FIG. 2, the unloading of the scrap metal in container 48 into the charge bucket 52 using the ramp 54 at a steel mill unloading station will be described. As may be appreciated, modifications may be made to the order in which the steps of the unloading process are presented in this discussion which will provide the same result (e.g., that the scrap metal is transferred from the container 48 into the charge bucket 52) without departing from the scope of the present invention.

Preferably, first the charge bucket 52 is moved along a pair of rails 76 such that the charge bucket 52 is positioned below the lower end 59 of the ramp 54. A hook 78 affixed to the hoisting cable 80 of a crane (not shown) is then attached to the bale 74. The container 48 full of scrap metal is then lifted by the crane from the transportation device (not shown) (e.g., railroad car, truck bed, etc.). Preferably, the bale 74 is pivoted in a line slightly in advance, (i.e., at a point slightly toward the front wall 62 of the container 48) of a line between the pair of opposed side walls corresponding to the center of gravity of container 48, such that when the container 48 is hoisted by the crane, the container 48 pivots about the bale 74 to cause the front of the container 48 to be raised higher in the air than the back of container 48. This embodiment is preferred as it causes the scrap metal in container 48 to be directed toward the rear wall 66 of the container 48 preventing the scrap metal from falling through the opening 64 in the front wall 62 during the hoisting operation. The container 48 is then placed over the ramp 54 and is lowered downwardly onto ramp 54. As it is lowered, the container 48 pivots about the bale 74 and is tilted or tipped causing the intersection of the base 61 and the front wall 62 to be lower than the intersection of the base 61 and the rear wall 66 causing the scrap metal within container 48 to, flow through the operation of gravity through the opening or aperture 64 in the front wall 62 of the container 48 and into the charge bucket 52. Forward movement of the container 48 down the ramp 54 is prevented by operation of stop 60 on container 48. When the scrap metal has been emptied from container 48, the crane then simply lifts the container 48 upwardly and replaces it on the transportation device (e.g., railcar, truck bed and the like).

Advantages of the present invention are numerous, and include without limitation that because no complex locking devices 44 of the prior art are required for the bale 74, the container 48 of the present invention is easier and less costly to manufacture and maintain over those presently available. The container 48 of the present invention is easier to use and results in faster unloading times because it is not necessary to place the container 48 on a platform 22 (or the bar 23 and lip 25) on the charge bucket 14 (illustrated in FIGS. 1A and 1B) and then release and reapply upward force on the bale 74 (illustrated in FIG. 2) in order to cause the release of a complex locking mechanism and then, still further, to drag the container forward to dump its contents, as is required by the presently available containers shown in FIGS. 1A and 1B. Still further, because the bale 74 of the container 48 lies flat along the top of container 48 when it is in its down or non-hoisting position 74*a*, multiple containers 48 can be stacked upon each other. In a preferred embodiment of the present invention, the stacked containers 48 are sized such that the stacked dimensions in length, width and height completely fill the space provided by the transportation device. For example, where the transportation device is a railcar, in a preferred embodiment of the present invention, the containers 48 are sized such that when multiple containers are stacked in a railcar, the containers just fit within the railcar with little or no wasting of the space within the railcar. Upon arrival at the unloading station at the steel mill, the containers 48 can be quickly, safely and efficiently unloaded into the charge bucket 52 in the manner described above, without any grappling operation.

Figure 3:
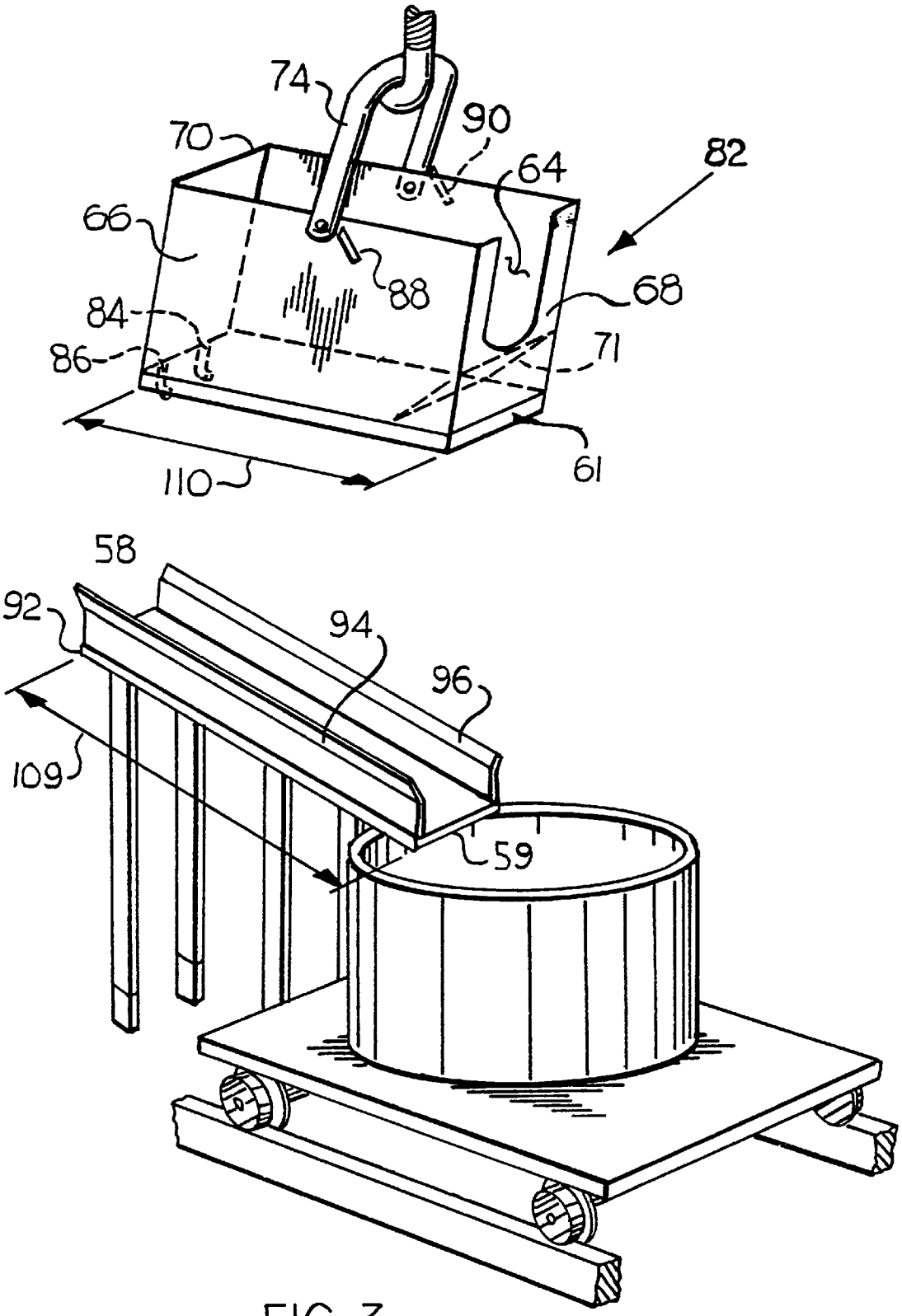
FIG. 3 is a side perspective view of an alternative embodiment of a materials handling device in accordance with the present invention illustrating the use of guide rails and hooks with a ramp assembly.

Referring now to FIG. 3, there is shown an alternative embodiment of the present invention in which certain additional elements are described in connection with the container and ramp of the present invention. More particularly, shown in FIG. 3, is a container 82 which is identical to container 48, but for the addition of hooks 84 and 86 and pivot stops 88 and 90. Ramp 92, shown in FIG. 3, is identical to ramp 54 of FIG. 2, but for the addition of guide rails 94 and 96.

Hooks 84 and 86 may be affixed to either the rear wall 66 or the bottom plate 61 of the container 82, and function to engage the upper end 58 of the ramp 92 as the container 82 is lowered onto the ramp 92 to prevent container 82 from traveling downwardly along ramp 92. Hooks 84 and 86 may be used in addition to or in lieu of stop 60 (illustrated in FIG. 2). The hooks 84 and 86 may either be simple gravity hooks or may be spring-biased outwardly. Further, as may be appreciated, the present invention is not limited to the two hooks 84 and 86 illustrated in FIG. 3, but may include a single hook (not shown) or a plurality of hooks (also not shown). Where a single hook is employed, it is preferably attached along the center line of container 82 to prevent container 82 from pivotally rotating on ramp 92 as the hook engages the upper end 58 of the ramp 92. In a preferred embodiment of the present invention, the hooks 84 and 86 are pivotally attached to the bottom plate 61 or the rear wall 66 of the container 82 to permit the hooks 84 and 86 to retract upwardly when the container 82 is placed on a surface. Where the hooks 84 and 86 are pivotally attached to the bottom plate 61 or the rear wall 66 of the container 82, it may be necessary to provide for indentations in the bottom plate 61 or the rear wall 66, respectively, to accommodate the hooks 84 and 86 in their retracted position.

Pivot stops 88 and 90 are illustrated in FIG. 3 and operate to provide a limit to the pivotal movement of the container 82 relative to the bale 74. The pivot stops 88 and 90 may be affixed at a first end, respectively, to the side walls 68 and 70 of the container 82, whereupon the pivotal rotation of the container 82 will cause the bale 74 to contact the pivot stops 88 and 90 to provide a limit to the pivotal rotation of the container 82 relative to the bale 74. Alternatively, as illustrated in FIG. 4A, the pivot stops 88 and 90 may be affixed to the bale 74 and caused to engage a seat or shoulder member 98 or 100 respectively, to provide a limit to the pivotal rotation of the bale 74 relative to the container 82.

Guide rails 94 and 96, illustrated in FIG. 3, are provided along the outer or longitudinal edges of the ramp 92 and operate to direct container 82 as it is lowered onto ramp 92. Guide rails 94 and 96 may each be of a simple wall-type design (not shown), which may extend perpendicularly and upwardly of the ramp 92 or which may extend upwardly and outwardly at an obtuse angle from the ramp 92 (also not shown). Alternatively, each of the guide rails 94 and 96 respectively include an outwardly projecting upper portion to provide a "y" shaped design, as illustrated in FIG. 3, in order to more fully direct the container 82 onto the ramp 92.

As may be appreciated, while several additional elements are disclosed in FIG. 3, the present invention is not limited only to the combination of additional elements provided in FIG. 3, but includes each element individually. For example, in an embodiment (not shown), the ramp 92 might include the guide rails 94 and 96 while the container 82 may not include hooks 84 and 86, but does include pivot stops 88 and 90. Alternatively, for example, the container 82 might include hooks 84 and 86 while ramp 92 does not include guide rails 94 and 96 and is, therefore, identical with ramp 54. This is also true of the elements disclosed in the remaining figures discussed below which may be freely combined to form alternative embodiments of the present invention.

Figure 5:
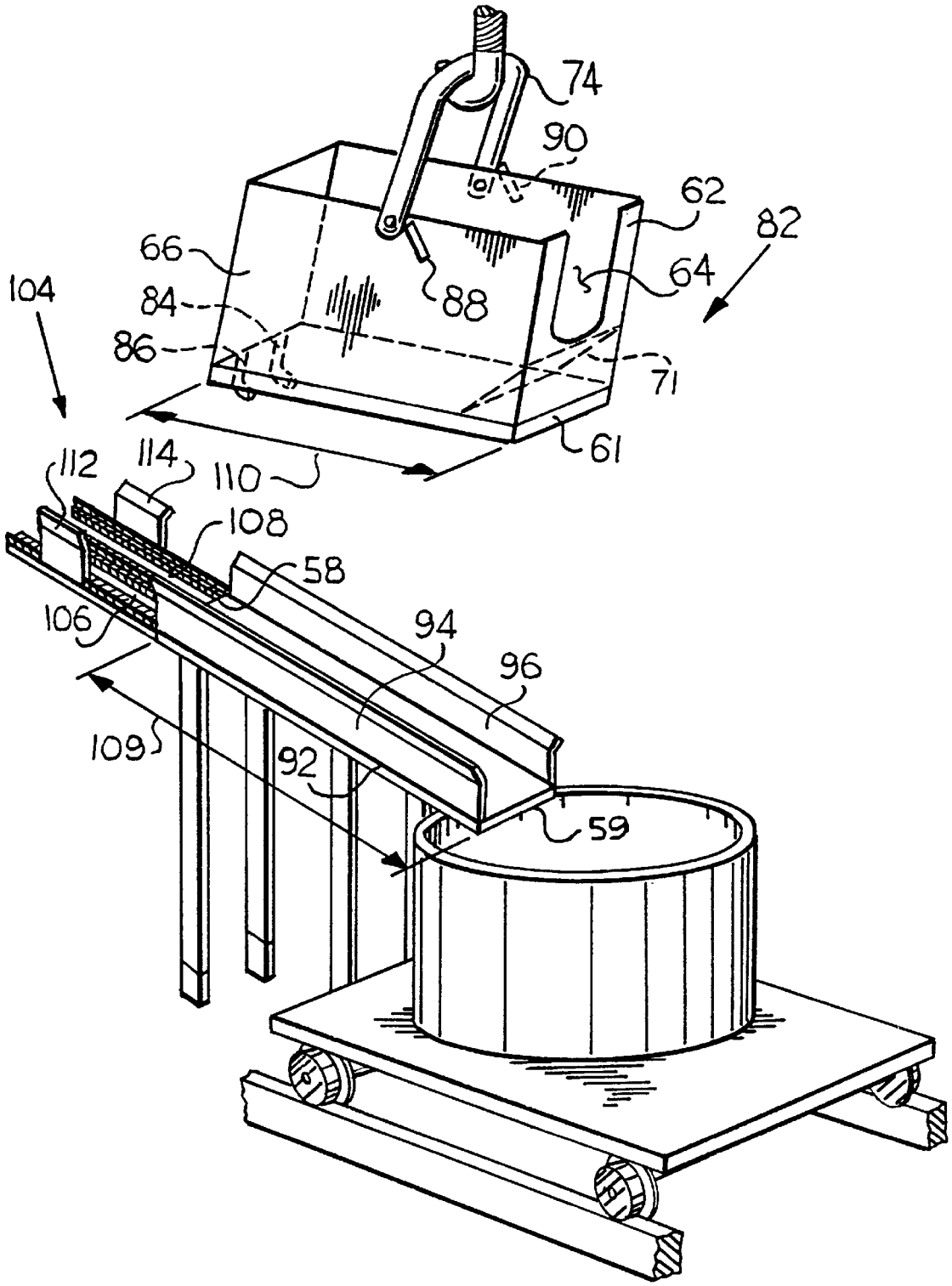
FIG. 5 is a side perspective view of an alternative embodiment of the materials handling device of the present invention illustrating the use of a ramp extension.

An alternative embodiment of the present invention is illustrated in FIG. 5. Illustrated in FIG. 5 is container 82 which is positioned over ramp 92. Ramp 92 further includes an extended portion or ramp extension 104 having slots 106 and 108 therein. While the figures are not necessarily drawn to scale, as may be appreciated in FIG. 3, the ramp 92 is illustrated in a length along a line 109 that is generally commensurate with the length of the container 82 along a line 110. This requires that the crane operator operate with a degree of precision when placing the container 82 on the ramp 92 to ensure that the container 82 is properly placed on ramp 92. While the ramp 92 could be extended further along the line 109, illustrated in FIG. 3, to provide a ramp 92 substantially larger than container 82, in an alterative embodiment illustrated in FIG. 5, the extended portion 104 provides additional surface area on which to place the container 82 providing the crane operator with a greater margin for error. The slots 106 and 108 accommodate the hooks 84 and 86 as the container 82 slides along the extended portion 104, whereupon the hooks 84 and 86 engage the upper end 58 and/or the front wall 62 of the container 82 engages the stop 60 to prevent and further forward movement of the container 82 when it has reached the lower end 59 of the ramp 92 in the same fashion as described above in connection with the discussion of FIG. 3. Extended portion 104 may or may not be equipped with guide rails, although it is illustrated in FIG. 5 with guide rails 112 and 114 which may or may not be continuous with guide rails 94 and 96, respectively. Extended portion 104 may be permanently affixed to ramp 92 or may be removably affixed thereto.

Figure 6:
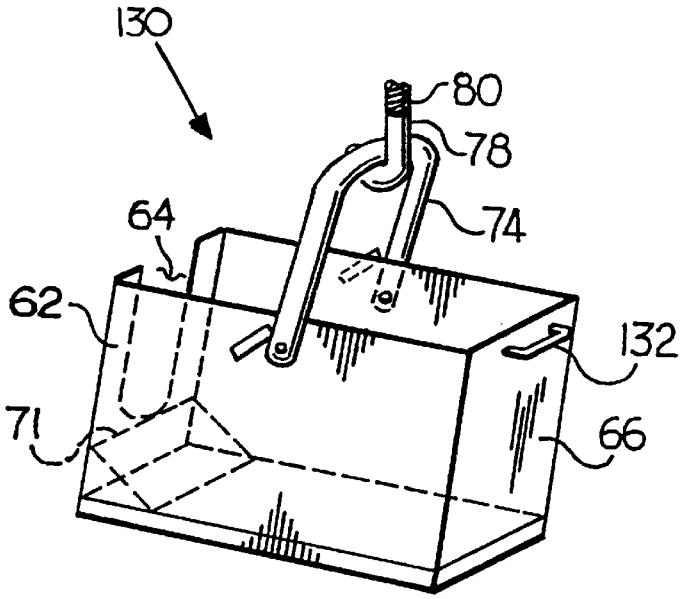
FIG. 6 is a side perspective view of an alternative embodiment of the materials handling device of the present invention illustrating the use of a substantially horizontal unloading platform.
Figure 6:
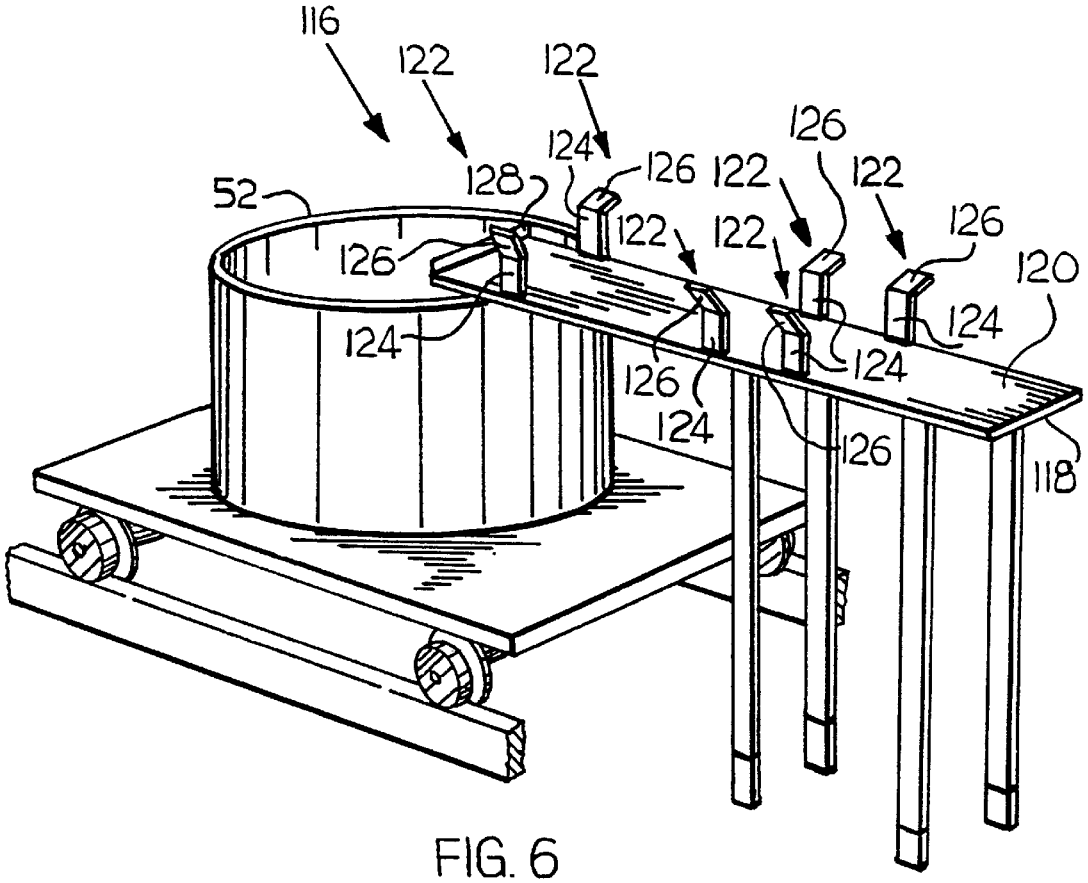

An alternative embodiment of the unloading system of the present invention is designated 116 in FIG. 6 of the drawings. In the unloading system 116, the inclined ramp is replaced with a substantially horizontal platform 118 having a substantially planar upper surface 120. A plurality of guides or guide posts 122 extend upwardly from the upper surface 120 of the platform 118. At least a portion of the guide posts 122 preferably have a first member 124 having a first surface attached to the upper surface 120 of the platform 118 and a second surface opposite the first surface, and a second member 126 also having a first surface and second surface opposite thereto, the first surface of the second member 126 being attached to the second surface of the first member 124 at an angle to the second surface of the first member 124 such that the second members 126 points outwardly from the platform 118 as illustrated in FIG. 6. A stop 128, such as a vertical wall or ledge, is located on or near the end of the platform 118 closest to the charge bucket 52. A container 130 for use with this unloading system 116 is similar to containers 48 (illustrated in FIGS. 2, 4B or 4C) or 82 (illustrated in FIGS. 3, 4A and 5), but includes a hoisting or dumping member 132 mounted on the exterior surface of the rear wall 66 of the container 130.

Operation of the unloading system 116 will now be described. A crane is attached to the bale 74 of the container 130 using the hook 78 and cable 80 as described above, and the container 130 is removed from its transportation device (e.g., railcar, truck bed or the like) by hoisting it with the crane. Again, the bale 74 is preferably offset with respect to the center of gravity of the container 130 such that the container 130 pivots about the bale 74 such that the rear wall 66 of the container 130 is lower than the front wall 62 of the container 130 when the container 130 is lifted by the crane to prevent accidental spilling of the scrap metal contained therein. The container 130 is then lowered with the crane onto the platform 118. The guide posts 122 guide the container 130 as it is being lowered to accurately position the container 130 on the platform 118. The guide posts 122 also prevent the container 130 from moving laterally and falling off of the platform 118. To empty the scrap metal from the container 130, the hook 78 of the crane is released from the bale 74 and is then attached to the dumping member 132. The exact form of the dumping member 132 is not limiting to the invention, but a handle which can engage hook 78 is one preferred embodiment. The crane is then raised such that the rear wall 66 of the container 130 is moved upwardly to dump the scrap metal from the container 130 into the open top of the charge bucket 52. The stop 128 prevents the front wall 62 of the container 130 from moving beyond the end of the platform 118. After the contents of the container 130 have been deposited into the charge bucket 52, the crane is lowered to lower the container 130 back onto the top of the platform 118. The hook 78 is then detached from the dumping member 132 and is reattached to the bale 74 so that the container 130 can be lifted from the platform 118 and replaced on the transportation device (e.g., railcar, truck bed and the like). Again, since the bale 74 pivots completely flat along the top of the container 130 when not hoisted, multiple containers 130 can be stacked one on top of another on the transportation device.

Figure 7:
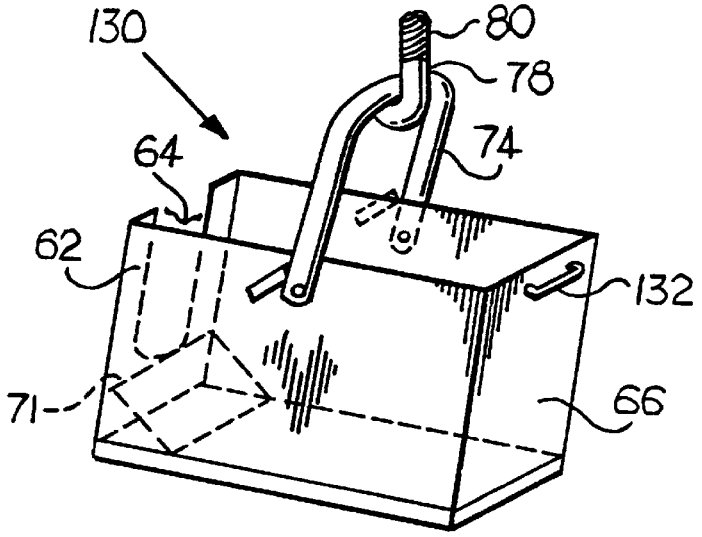
FIG. 7 is a side perspective view of an alternative embodiment of the materials handling device of the present invention illustrating the use of a substantially horizontal hinged unloading platform.
Figure 7:
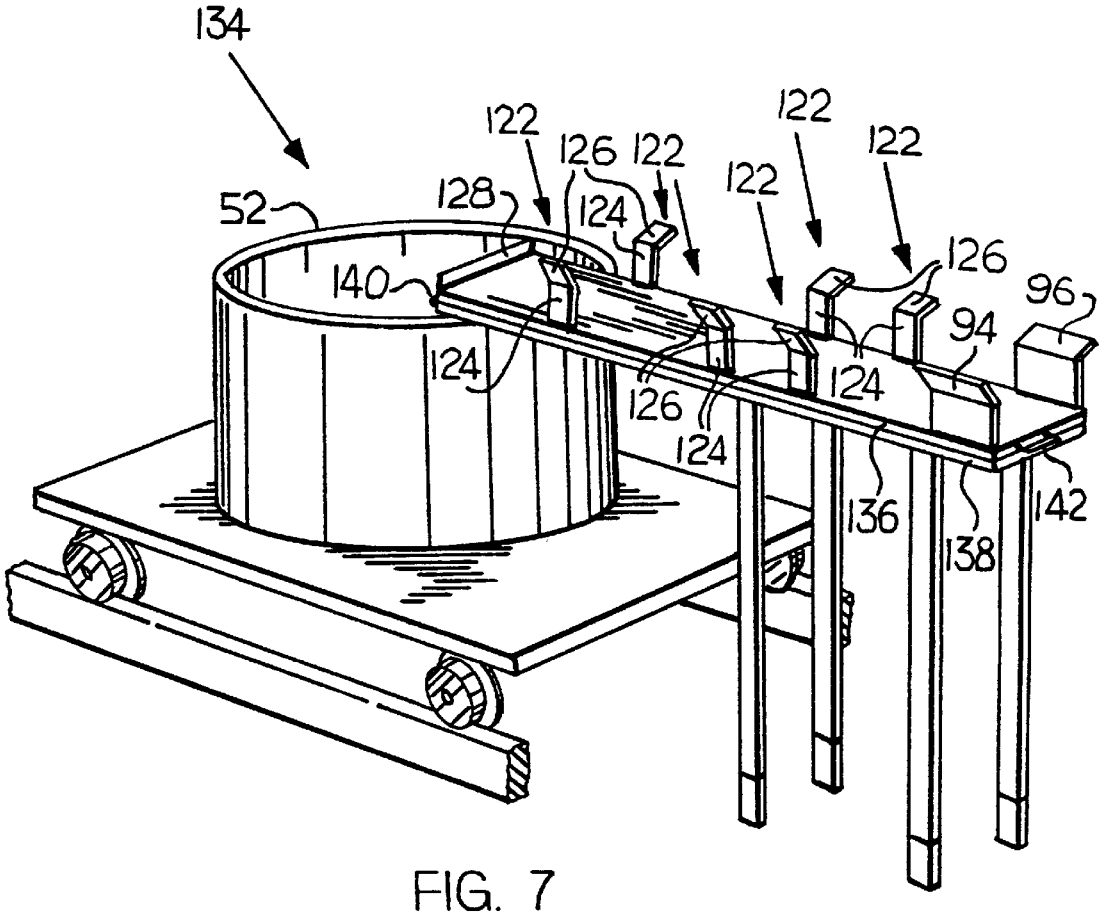

Illustrated in FIG. 7 is yet another embodiment of the present invention, which is similar to that of FIG. 6, except that the platform 134 illustrated in FIG. 7 is comprised of a generally planar upper section 136 and a generally planar lower section 138. The upper section 136 and the lower section 138 are hinged relative to one another via hinge member 140 illustrated in FIG. 7. Upper section 136 also includes engaging or dumping member 142 which may be engaged by a hook 78 attached by a cable 80 to a crane (not shown). Upper section 136 may be fitted with guide posts such as guide posts 122 as described above and as illustrated in FIG. 7 and/or guide rails, such as guide rails 94 and 96, also described above and also as illustrated in FIG. 7.

Operation of the unloading system of FIG. 7 will now be described. A crane is attached to the bale 74 of a container such as that of containers 48, 82 and 130 described above, although container 130 will be described by way of example. The crane is attached to the container 130 using the hook 78 and cable 80 as described above, and the container 130 is removed from its transportation device (e.g., railcar, truck bed or the like) by hoisting it with the crane. Again, the bale 74 is preferably offset with respect to the center of gravity of the container 130 such that the container 130 pivots about the bale 74 such that the rear wall 66 of the container 130 is lower than the front wall 62 of the container 130 when the container 130 is lifted by the crane to prevent accidental spilling of the scrap metal contained therein. The container 130 is then lowered with the crane onto the platform 134. The platform 134 is shown in FIG. 7 equipped with guide posts 122 and/or rails 94 and 96 which guide the container 130 as it is being lowered, and function to accurately position the container 130 on the platform 134 and prevent the container 130 moving laterally and falling off of the platform 134 as described above in connection with FIG. 6. To empty the scrap metal from the container 130, the hook 78 of the crane is released from the bale 74 and is then attached to the dumping member 142. The exact form of the dumping member 142 is not limiting to the invention, but a handle which can engage hook 78 is one preferred embodiment. The crane is then raised such that the upper section 136 of the platform 134 is caused to rotate about hinge member 140, whereupon the upper section 136 functions as a ramp similar to that of ramps 92 (illustrated in FIG. 5) and/or 54 (illustrated in FIG. 2) described above. Upper section 136 of platform 134 is raised until the scrap metal is caused to be emptied from the container 130 into the open top of the charge bucket 52. The stop 128 prevents the front wall 62 of the container 130 from moving beyond the end of the platform 134. After the contents of the container 130 have been deposited into the charge bucket 52, the crane is lowered to lower the upper section 136 of the platform 134 back to its generally horizontal position on top of lower section 138 of platform 134. The crane hook 78 is then detached from the dumping member 142 and is reattached to the bale 74 so that the container 130 can be lifted from the platform 134 and replaced on the transportation device (e.g., railcar, truck bed and the like).

Figure 8:
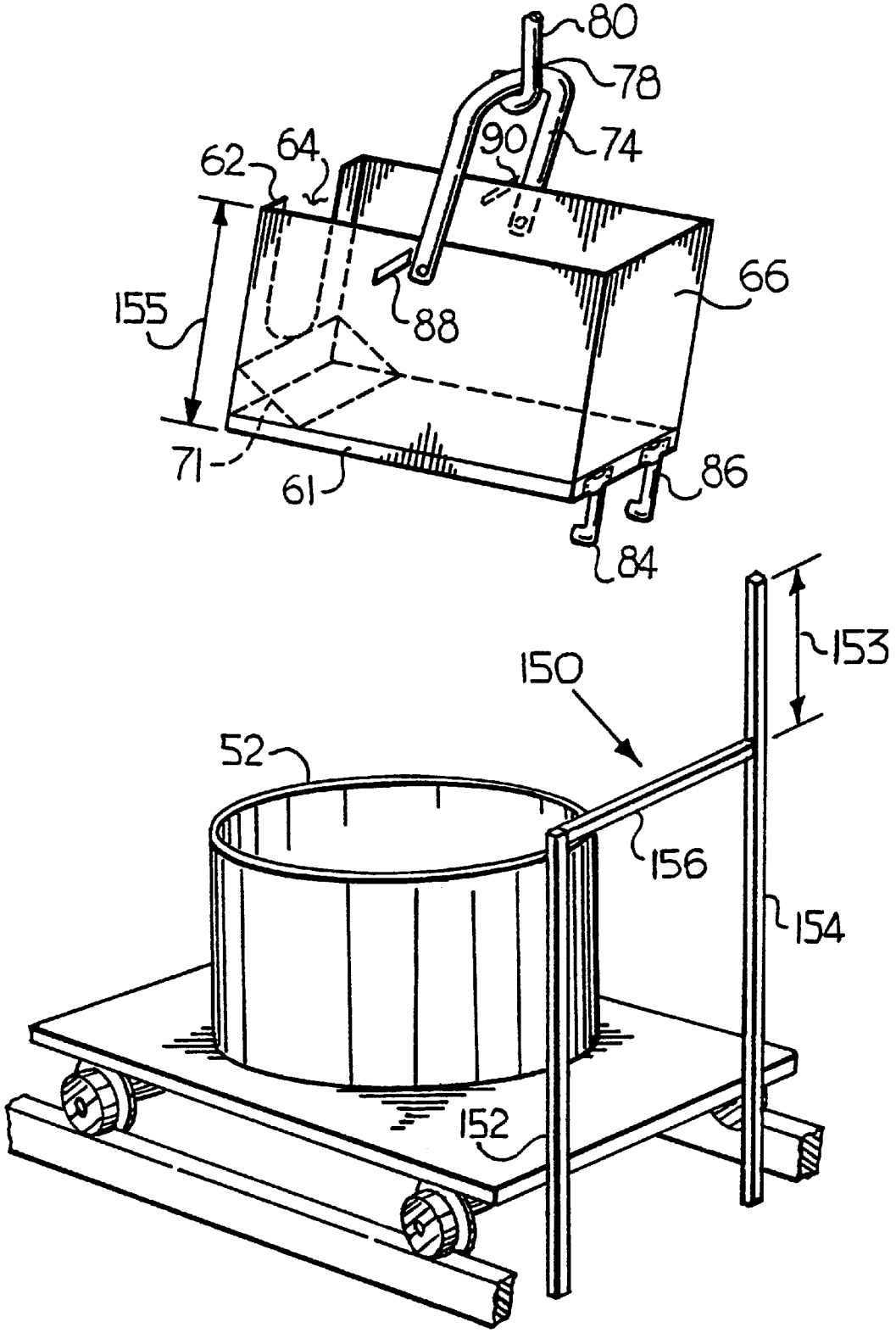
FIG. 8 is a side perspective view of an alterative embodiment of the materials handling device of the present invention illustrating a bar and cross member-type dumping member.

Still yet another embodiment of the present invention is illustrated in FIG. 8, which is similar to FIG. 2, except that the unloading station ramp 54 of FIG. 2 has been replaced by dumping member 150. The dumping member 150 includes one or more and preferably a pair of vertical supports 152 and 154 which are connected by a generally horizontal engaging member 156. The vertical supports may extend in a vertical direction only to the point where it joins horizontal engaging member 156 as shown by the vertical support 152 in FIG. 8, or they may extend vertically beyond that point as illustrated by the vertical support 154 in FIG. 8. Extending vertically upward beyond that point is preferred, and it is still more preferred to extend upwardly a distance illustrated by line 153 that is generally equivalent to the height of the container 82 as illustrated by line 155 to provide a guide post for container 82 as it is brought in contact with the dumping member 150.

The operation of the unloading system of FIG. 8 will now be described. A crane is attached to the bale 74 of the container 82 using the hook 78 and cable 80 as described above, and the container 82 is removed from its transportation device (e.g., railcar, truck bed or the like) by hoisting it with the crane. Again, the bale 74 is preferably offset with respect to the center of gravity of the container 82 such that the container 82 pivots about the bale 74 such that the rear wall 66 of the container 82 is lower than the front wall 62 of the container 82 when the container 82 is lifted by the crane to prevent accidental spilling of the scrap metal contained therein. The hook 78 and, therefore, the container 82 are continually lowered and moved toward the charge bucket 52 with the crane until the hooks 84 and 86 engage horizontal engaging member 156. The container 82 is then caused to pivotally rotate upon its hooks 84 and 86 about the engaging member 156 by continually lowering the hook 78 with the crane, until the front wall 62 of the container 82 is sufficiently lower than the rear wall 66 of the container 82 that the scrap metal in container 82 is caused to fall into the charge bucket 52 through opening 64 in the front wall 62 of the container 82. The crane is then raised such that the container 82 is caused to rotate by its hooks 84 and 86 about engaging member 156 and by virtue of the bale 74 being offset with respect to the center of gravity of the container 82 as described above. The crane hook 78 is then moved in a direction away from the charging bucket 52 to permit the hooks 84 and 86 of the container 82 to disengage themselves from horizontal engaging member 156. The container 82 is then replaced by the crane on the transportation device (e.g., railcar, truck bed and the like).

Figure 9A:
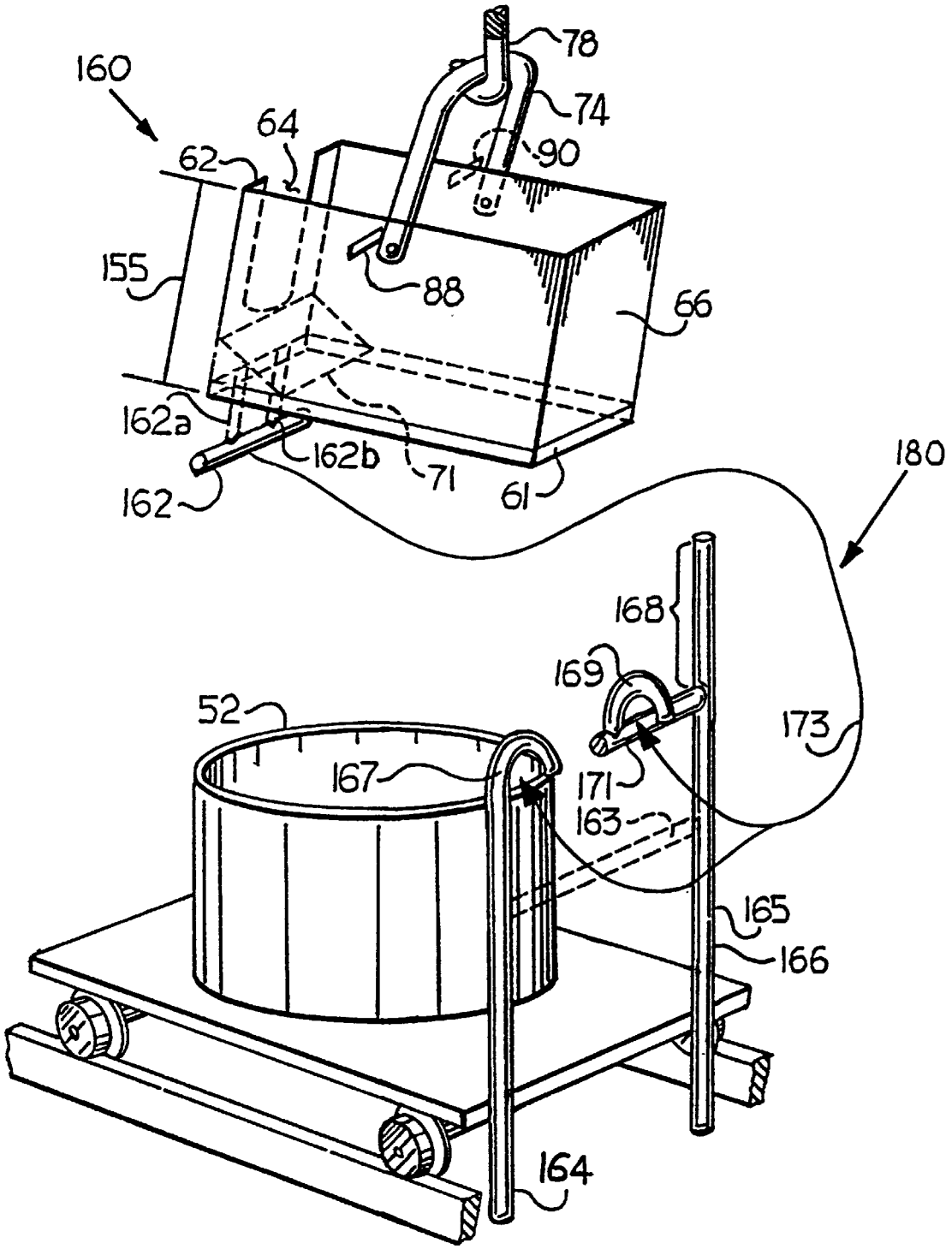
FIGS. 9A and 9B are each side perspective views of alterative embodiments of the materials handling device of the present invention illustrating the use a hook-type dumping member.

Another embodiment of the present invention is illustrated in FIG. 9A, which is similar to that of FIG. 8 except that the container 160 of FIG. 9A does not include hooks 84 and 86, but instead includes horizontal engaging member 162. Horizontal engaging member 162 is removably or permanently affixed or integrally formed as part of either the front wall 62 or bottom plate 61 or both of container 160 and is adapted to engage one or more vertical engaging members. Preferably, the horizontal engaging member 162 is adapted to retract upwardly or pivotally to permit containers 160 to be stacked on top of each other for transportation or storage. Where horizontal engaging member 162 retracts, it may be urged to its non-retracted position by gravity or spring biasing means among others. The precise form of the attachment of the horizontal engaging member 162 to the front wall 62 or the bottom plate or base 61 is not limiting to the invention. However, illustrated in FIG. 9A, are two attachment members 162*a* and 162*b* which extend downwardly in a plane generally parallel with front wall 62 of container 160 to which horizontal engaging member 162 is mounted or otherwise affixed, extending generally perpendicular to the attachment members 162*a* and 162*b*. Illustrated in FIG. 9A is the unloading station 180 which includes two vertical engaging members 164 and 166. While preferably the vertical engaging members are identical, as for purposes of brevity, illustrated in FIG. 9A are two different vertical engaging members and either or pairs of both may be employed in accordance with the present invention. The first vertical engaging member 164 includes a hook-type engaging portion 167 that is adapted to engage horizontal engaging member 162 of container 160. There is alternatively illustrated in FIG. 9A vertical engaging member 166 which includes a vertical post portion 165 and a hook-type engaging portion 169 which is offset from the vertical post portion 165 by support member 171. The vertical engaging member 166 also includes a vertically extending portion 168 which extends vertically above its hook-type engaging portion 169. The vertically extending portion 168 can function as a guide post for the container 160, and particularly so where both vertical engaging members are of the type of vertical engaging member 166, each including a vertically extending portion together providing a structure generally reminiscent of a football goal post. In an alternative embodiment of the invention, the vertical engagement members 164 and 166 may include a horizontal cross member 163 connecting the two vertical engaging members 164 and 166 as illustrated in phantom in FIG. 9A. In an embodiment (not shown), support member 171 may be extended between the engaging members 164 and 166 to form the cross member 163 described above in FIG. 9A. The precise shape of the horizontal engaging member 162 is not limiting to the present invention and can be cylindrical, square, rectangular, or U-shaped in cross section, among others. A bar-shaped horizontal engaging member 162 is generally preferred.

The process of emptying the contents of the container 160 into the charge bucket 52 is much the same as that described above in connection with container 82 in FIG. 8. More particularly, once the container 160 has been hoisted by its bale 74 with the crane, it is lowered over the vertical engaging members 164 and 166 until the horizontal engaging member 162 of the container 160 engages the vertical engaging members 164 and 166 as illustrated by the double headed arrow 173. The container 160 is then hoisted by the cable upwardly and forwardly causing the container 160 to pivot about its horizontal engaging member 162 and bale 74 such that the front wall 62 of the container 160 is caused to be lower than the rear wall 66 of the container 160, whereupon the scrap metal in the container 160 is caused to fall through the opening 64 into the charge bucket 52. The crane is then lowered such that the container 160 is caused to rotate by virtue of the bale 74 being offset with respect to the center of gravity of the container 160 in the same fashion as that described above in connection with container 82 (illustrated in FIG. 8). The crane hook 78 affixed to the bale 74 is then moved in a direction downwardly away from the charging bucket 52 to permit the horizontal engaging member 162 to disengage itself from vertical engaging members 164 and 166. The container 160 is then replaced by the crane on the transportation device (e.g., railcar, truck bed and the like).

Figure 9B:
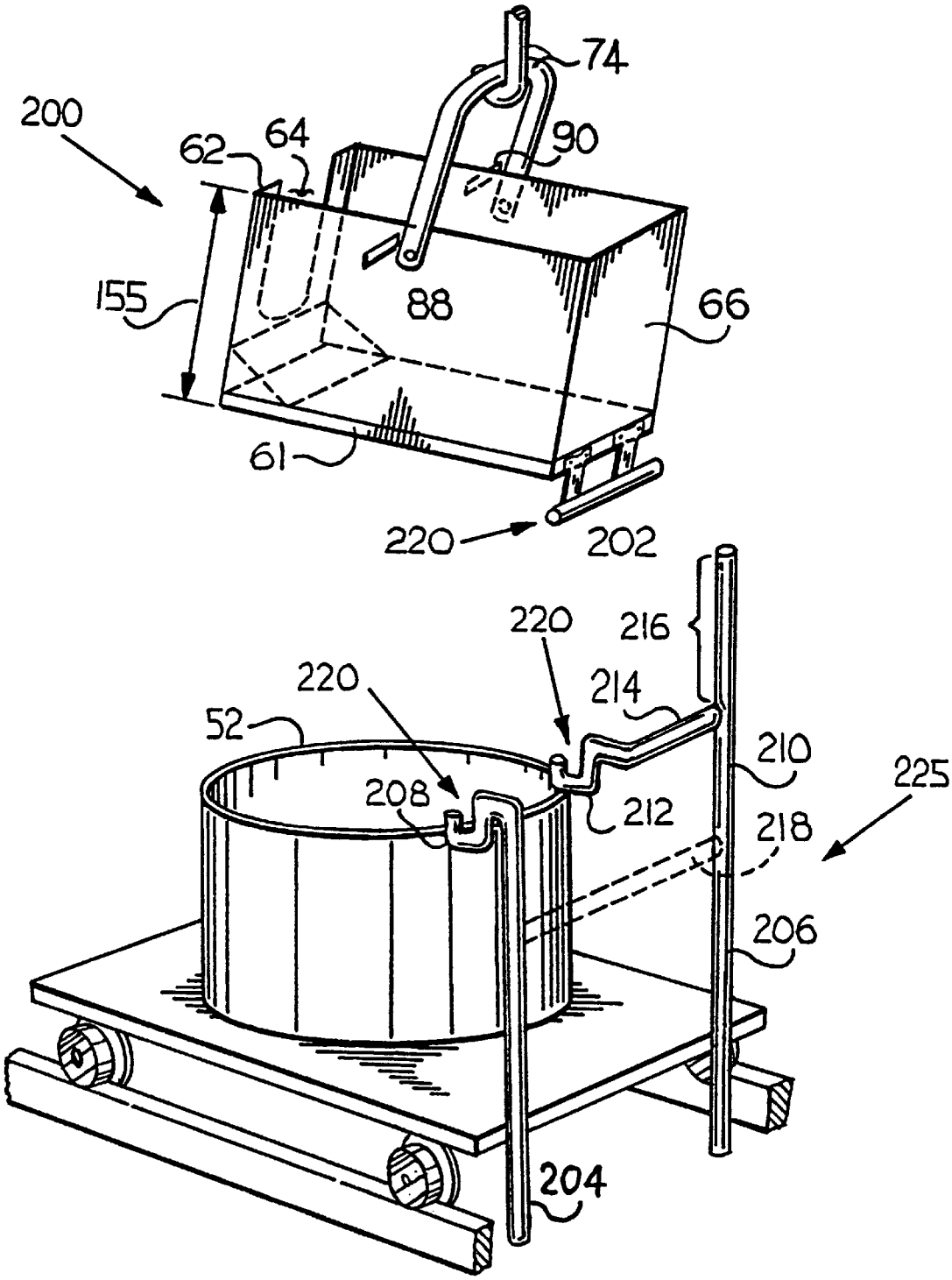

Yet another embodiment of the present invention is illustrated in FIG. 9B, which is similar to that of FIG. 9A, except that horizontal engaging member 202 of a container 200 of FIG. 9B is affixed in the general area of the rear wall 66 of the container 200. More particularly, horizontal engaging member 202 may be removably or permanently affixed or integrally formed as part of either the rear wall 66 or bottom plate 61 of the container 200, and is adapted to engage one or more vertical engaging members. Horizontal engaging member 202 may be adapted to retract upwardly or pivotally to permit containers 200 to be stacked on top of each other for transportation or storage. Where horizontal engaging member 202 is adapted to retract upwardly or pivotally, it is preferably fitted with a locking mechanism (not shown) to prevent such pivoting or retraction during the process of emptying the contents of the container 200 into the charge bucket 52.

Illustrated in FIG. 9B is unloading station 225 which includes two vertical engaging members 204 and 206. While preferably the vertical engaging members are identical, for purposes of brevity, illustrated in FIG. 9B are two different vertical engaging members and either or pairs of both may be employed in accordance with the present invention.

Vertical engaging member 204 includes a hook-type engaging portion 208 that is adapted to engage horizontal engaging member 202 of container 200. There is alternatively illustrated in FIG. 9B vertical engaging member 206 which includes a vertical post portion 210 and a hook-type engaging portion 212 which is offset from the post portion 210 by support member 214. The vertical engaging member 206 also includes a vertically extending portion 216 which extends vertically above its hook-type engaging portion 212. The vertically extending portion 216 can function as a guide post for the container 200, and particularly so where both vertical engaging members 204 and 206 are of the type of vertical engaging member 206, each including a vertically extending portion which together provide a structure generally reminiscent of a football goal post. In an alternative embodiment of the present invention, the vertical engaging members 204 and 206 may be connected by a horizontal cross member 218, connecting the two vertical engaging members 204 and 206 as illustrated in phantom in FIG. 9B. In an alternative embodiment of the present invention (not shown), support member 214 may be extended between the engaging members 204 and 206 to form the cross member 218.

The process of emptying the contents of the container 200 into the charge bucket 52 is much the same as that described above in connection with FIG. 9B. More particularly, once the container 200 has been hoisted by its bale 74 with the crane, it is lowered over the vertical engaging members 204 and 206 until the horizontal engaging member 202 of the container 200 engages the hook portions of the vertical engaging members 204 and 206 as illustrated by a double headed arrow 220. Further lowering of the cable downwardly causes the container 200 to pivot about the horizontal engaging member 202 and bale 74 such that the front wall 62 of the container 200 is caused to be lower than the rear wall 66 of the container 200 whereupon the scrap metal in the container 200 is caused to fall through the opening 64 into the charge bucket 52. The crane is then raised such that the container 200 is caused to rotate by virtue of the bale 74 being offset with respect to the center of gravity of the container 200 in the same fashion as described above in connection with containers 48 and 82. The hook 78 affixed to the bale 74 is then moved in a direction generally upwardly and away from the vertical engaging members 204 and 206 to permit the horizontal engaging member 202 to disengage itself from vertical engaging members 204 and 206. The container 200 is then replaced by the crane on the transportation device (e.g., railcar, truck bed and the like).

Figure 10A:
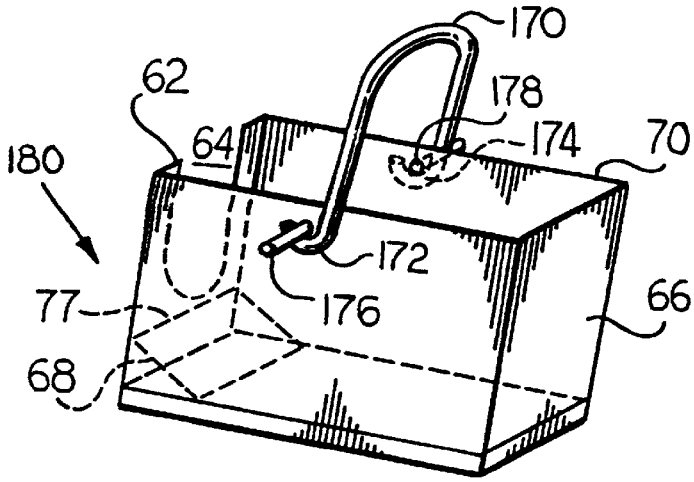
FIGS. 10A, 10B, 10C and 10D are side perspective views of alternative embodiments of the materials handling device of the present invention illustrating alternative embodiments for associating a removable bale with the container of the present invention.
Figure 10B:
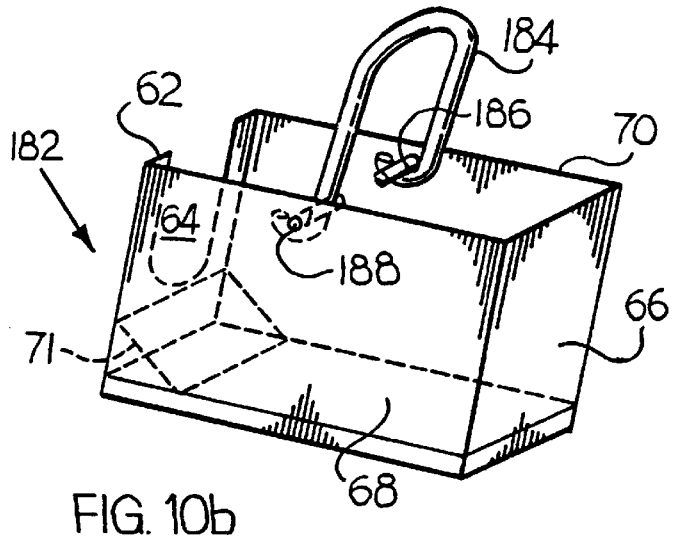
Figure 10C:
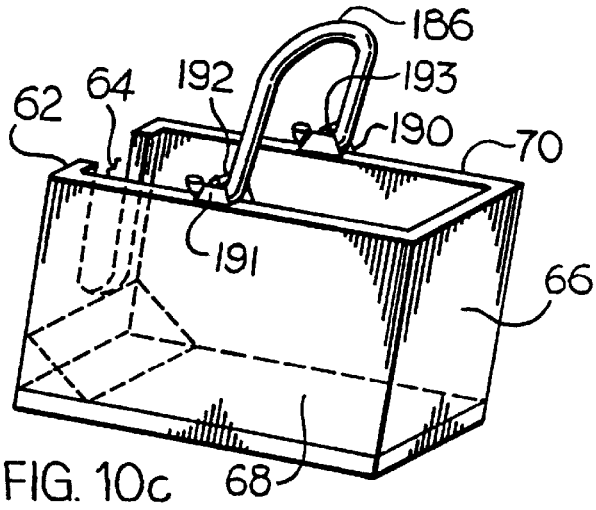
Figure 10D:
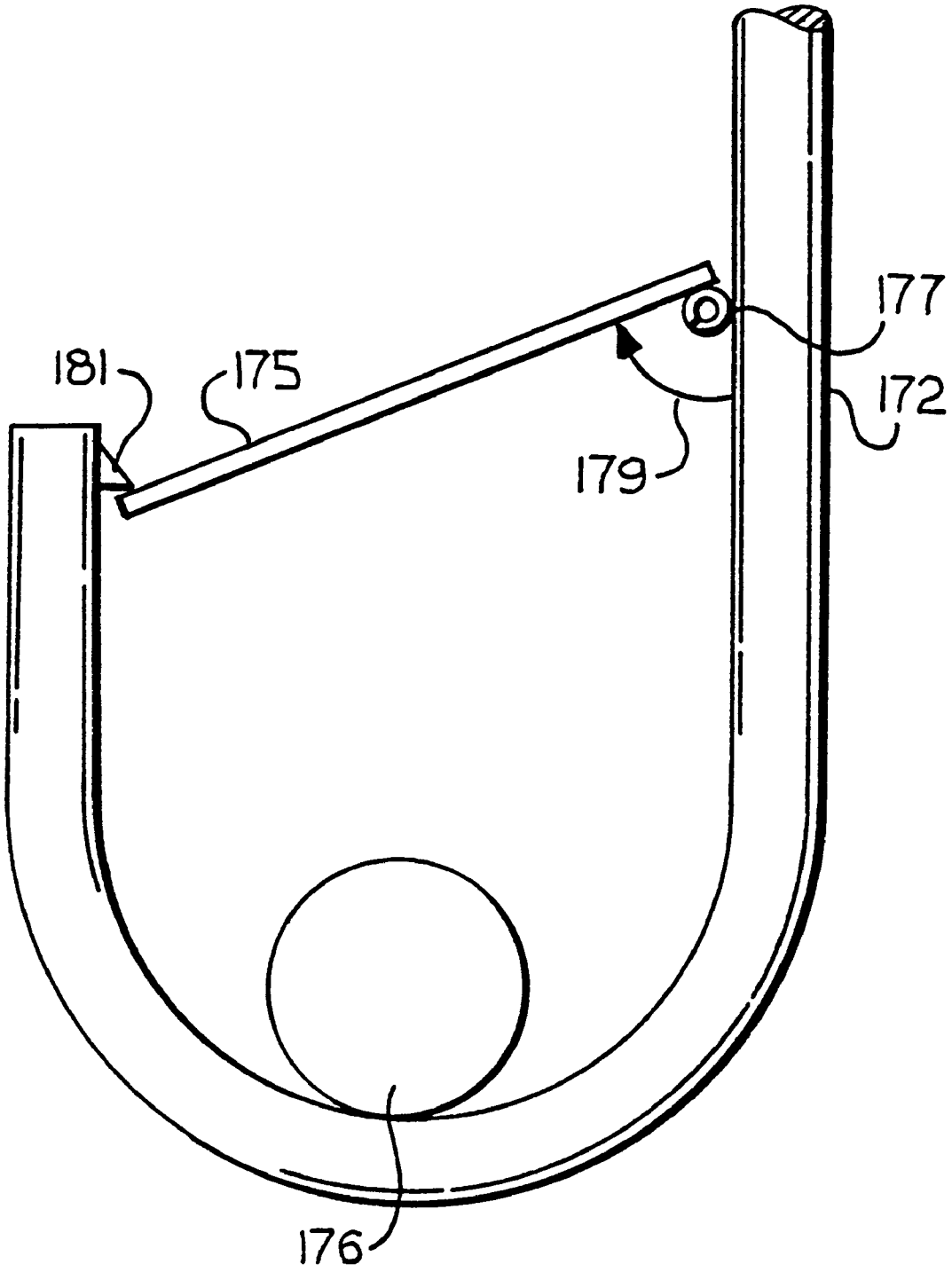

The bale of the present invention has been described as being pivotally connected to the containers of the present invention. However, in yet another embodiment of the present invention, the bale may be removably associated with any of the above-described containers of the present invention using the bales illustrated in FIGS. 10A, 10B and 10C. As illustrated in FIG. 10A, a bale 170 is a generally U-shaped member having hooks 172 and 174 at each end. The hooks 172 and 174 may be integral with the bale 170 or may be permanently or removably affixed thereto. Further, the hooks 172 and 174 may include a safety catch or locking mechanism 175 as illustrated in FIG. 10D, which locking mechanism 175 may be biased as, for example, by spring 177 upwardly in the direction of the arrow 179 against a stop 181 to prevent the bale from disengaging itself from engaging member 176 unexpectedly. The hooks 172 and 174 are adapted to engage engaging members 176 and 178 which are affixed to container 180 as shown in FIG. 10A. The engaging members 176 and 178 are not limiting to the present invention provided they permit the pivotal rotation of the bale 170 relative to the container 180, however, a simple post design is generally preferred. Also, while illustrated in FIG. 10A as extending outwardly from the exterior surface of the side walls 68 and 70 of the container 180, the engaging members 176 and 178 need not be so and may in fact extend inwardly from the interior surface of the side walls 68 and 70 of the container 182 (illustrated in FIG. 10B), with appropriate narrowing of the bale 184 over that shown in FIG. 10A to permit it to engage the inwardly facing engaging members 186 and 188 as shown in FIG. 10B. The engaging members may also be provided on the top surfaces of side walls 68 and 70 as part of mounting assemblies 191 and 193 with appropriate modification of the width of bale 184 shown in FIG. 10C to accommodate this positioning of the engaging members 190 and 192. The method of affixation of the engaging members 172, 174, 186, 188, 190 and 192 (illustrated in FIGS. 10A, 10B and 10C) to the side walls 68 and 70 is also not limiting to the present invention and can include any known or hereinafter developed methods of attachment including integral forming, bolting and/or welding among others. Again, the bales illustrated in FIGS. 10A, 10B and 10C are all preferably offset with respect to the center of gravity of the respective container such that the container pivots about the bale such that the rear wall 66 of the container is lower than the front wall 62 of the container when the container is lifted by the crane to prevent accidental spilling of the scrap metal contained therein. A removable bale has several advantages, including, but not limited to, reduced costs for producing the containers as each container does not require its own bale.

It will be readily appreciated by those skilled in the art that modifications be made to the invention without departing from the concepts disclosed in the foregoing description. Such modifications are to be considered as included within the scope of the invention. Accordingly, the particular embodiments described in detail here and above are illustrative only and are not limiting to the scope of the invention which is to be given the full breadth of the above disclosure and any and all equivalents thereof.

What is claimed is:

1. A materials handling system, comprising:

a container including a base, a front wall, a rear wall and a pair of opposed side walls wherein at least a portion of the front wall, the rear wall and the pair of opposed side walls are each affixed to the base, and wherein the base, the front wall and the pair of opposed side walls cooperatively form the container having an interior space for receiving materials therein;

a bale having a first and second end portion, wherein the first end portion of the bale is pivotally associated with a first of said pair of opposed side walls and the second end portion of the bale is pivotally associated with the second side wall to permit pivotal rotation of the bale relative to the container;

an unloading station, the unloading station including a means for positioning and securing the container over a repository adapted to receive materials contained within the container and transferring such materials from the container to the repository;

wherein a plurality of said containers is stably stackable upon one another when fully loaded with such materials;

wherein the front wall of the container includes an aperture therein, said aperture being of sufficient dimension to permit material retained in the container to pass through said aperture by the operation of gravity when the container is sufficiently tipped such that a portion of said aperture is at a lower elevation than an intersection between the base and the rear wall; and wherein the container further comprises a ramp extending between the pair of opposed side walls within the interior space of the container, said ramp having a first end and a second end, wherein the first end of said ramp is associated with the base of the container at a point forward of the midpoint of said base and the second end of the ramp is associated with the front wall of the container at a point on the front wall that is below the aperture.

2. The materials handling system of claim 1, wherein the bale is pivotally associated with the container along a line located at a point between the front wall and a line extending between the pair of opposed side walls corresponding to a center of gravity of the container, whereupon the container pivots about the bale to cause the front wall of the container to be raised higher than the back wall of the container when the container is lifted by the bale.

3. The materials handling system of claim 2, wherein the container further comprises a first bar member affixed to the first side wall and extending externally of the container and generally perpendicular to the first side wall and a second bar member affixed to the second side wall and extending externally of the container and generally perpendicular to the second side wall, wherein the first and second end portions of the bale each include an aperture therein adapted to receive said first or second bar member, respectively, whereupon the bale is affixed to the container by a simple pivot to permit pivotal rotation of the bale relative to the container.

4. The materials handling system of claim 2, wherein the container further comprises a first bar member affixed to the first side wall and extending internally of the container and generally perpendicular to the first side wall and a second bar member affixed to the second side wall and extending internally of the container and generally perpendicular to the second side wall, wherein the first and second end portions of the bale each include an aperture therein adapted to receive said first or second bar member, respectively, whereupon the bale is affixed to the container by a simple pivot to permit pivotal rotation of the bale relative to the container.

5. The materials handling system of claim 2, wherein the container further comprises a first mounting assembly affixed to a top surface of the first side wall of the container and generally perpendicular to the first side wall and a second mounting assembly affixed to a top surface of the second side wall and generally perpendicular to the second side wall, wherein the first and second end portions of the bale each include an aperture therein adapted to receive said first or second bar member, respectively, whereupon the bale is affixed to the top surfaces of the side walls of the container by a simple pivot to permit pivotal rotation of the bale relative to the container.

6. The materials handling system of claim 5, wherein the base of the container is adapted to receive said first and second mounting assemblies to permit a plurality of the containers to be stably stacked upon one another.

7. The materials handling system of claim 6, wherein one or more of the side walls are adapted to receive said first and second mounting assemblies.

8. The materials handling system of claim 1, wherein the bale is affixed to the container by a simple pivot.

9. The materials handling system of claim 1 wherein the bale is removably associated with the container.

10. The materials handling system of claim 9, wherein each of the side walls of the container further comprises an engaging member, wherein the first and second end portions of the bale each further comprise a hook, wherein said hooks are adapted to be removably associated with said engaging members whereupon when the hooks are engaged with the engaging members, the container can be lifted and moved by the bale and whereupon the bale can be completely dissociated from the container when not used to lift or move the container.

11. The materials handling system of claim 10, wherein at least one of said hooks further comprises a safety catch.

12. The materials handling system of claim 1, wherein the unloading station further comprises an inclined unloading ramp having a longitudinal axis and a transverse axis.

13. The materials handling system of claim 12, wherein the unloading ramp has an upper end and a lower end further comprising a stop on the lower end of the inclined unloading ramp.

14. The materials handling system of claim 12, wherein the unloading ramp further comprises a member selected from the group consisting of one or more pairs of opposed guide rails extending longitudinally along the longitudinal axis of the unloading ramp, one or more guide posts extending generally perpendicular to the surface of the unloading ramp, and combinations thereof.

15. The materials handling system of claim 12, wherein the container further comprises one or more hooks extending downwardly and generally perpendicular to the base and generally adjacent the rear wall of the container, said hooks being adapted to grasp the upper end of the unloading ramp to prevent the container from sliding downwardly along the unloading ramp when the container is placed on the unloading ramp.

16. The materials handling system of claim 15 further comprising a ramp extension associated with the upper end of the unloading ramp.

17. The materials handling system of claim 16, wherein the ramp extension further comprises a plurality of slots arranged along the longitudinal axis of the ramp extension, said slots being adapted to accept said one or more hooks whereupon said hooks slide within said slots and engage the upper end of the unloading ramp as the container slides downwardly along the unloading ramp when the container is placed on the unloading ramp.

18. The materials handling system of claim 12 further comprising a ramp extension associated with the upper end of the unloading ramp.

19. The materials handling system of claim 1, wherein the unloading station further comprises a substantially horizontal platform having a longitudinal axis, a transverse axis, a first end and a second end, and the container further comprises a hoisting member associated with a member selected from the group consisting of the rear wall of the container and the base of the container adjacent the rear wall of the container.

20. The materials handling system of claim 19, wherein the hoisting member is associated with the external surface of the rear wall of the container.

21. The materials handling system of claim 19, wherein the unloading station further comprises a stop on the first end of the horizontal platform.

22. The materials handling system of claim 19, wherein the platform further comprises a member selected from the group consisting of one or more pairs of opposed guide rails extending longitudinally along the longitudinal axis of the platform, one or more guide posts extending generally perpendicular to the surface of the platform, and combinations thereof.

23. The materials handling system of claim 1, wherein the unloading station further comprises a substantially horizontal platform having a longitudinal axis, a transverse axis, a first end and a second end wherein the horizontal platform is further comprised of a generally planar upper section, a generally planar lower section and a hinge member associated with the upper section and the lower section at the first end of the platform, wherein the hinge member provides rotational movement of the upper section relative to the lower section about the hinge member.

24. The materials handling system of claim 23, wherein the unloading station further comprises an engaging member associated with the second end of the upper section.

25. The materials handling system of claim 24, wherein the unloading station further comprises a stop on the first end of the horizontal platform.

26. The materials handling system of claim 25, wherein the container further comprises a hoisting member associated with a member selected from the group consisting of the rear wall of the container and the base of the container adjacent the rear wall of the container.

27. The materials handling system of claim 26, wherein the hoisting member is associated with the external surface of the rear wall of the container.

28. The materials handling system of claim 23, wherein the platform further comprises a member selected from the group consisting of one or more pairs of opposed guide rails extending longitudinally along the longitudinal axis of the platform, one or more guide posts extending generally perpendicular to the surface of the platform, and combinations thereof.

29. The materials handling system of claim 1, wherein the unloading station further comprises a dumping member and the container further comprises one or more hooks extending downwardly and generally perpendicular to the base and generally adjacent the rear wall of the container, said hooks being adapted to engage the dumping member.

30. The materials handling system of claim 29, wherein the dumping member is comprised of at least one vertical support and a horizontal engaging member, wherein said hooks are adapted to engage the dumping member.

31. The materials handling system of claim 30 wherein the dumping member is comprised of a pair of spaced vertical supports and a horizontal engaging member interposed between and associated with the vertical supports, wherein each of said vertical supports extends upwardly beyond a point of association between the horizontal engaging member and the respective vertical supports, wherein said vertical supports function to guide and orient the container during transfer of materials from the container to the repository.

32. The materials handling system of claim 1, wherein the container further comprises a horizontal engaging member associated with a member selected from the group consisting of the front wall, the base of the container in an area adjacent the front wall of the container, and combinations thereof.

33. The materials handling system of claim 32, wherein the horizontal engaging member is spaced downwardly from the base of the container by one or more vertical attachment members.

34. The materials handling system of claim 32, wherein the unloading station further comprises at least two vertical engaging members, each of said vertical engaging members further comprising a hook-type engaging member, wherein said hook-type engaging member is adapted to engage the horizontal engaging member of the container such that an upward force exerted on the bale causes the container to rotate about the hook-type engaging member, thereby transferring materials contained within the container to the repository.

35. The materials handling system of claim 34, wherein at least one of the vertical engaging members further comprises a vertically extending portion which extends upwardly beyond the hook-type engaging members wherein said vertically extending portion functions to guide and orient the container during transfer of materials from the container to the repository.

36. The materials handling system of claim 35 further comprising a support member extending transversely from the longitudinal axis of the vertical engaging member, wherein said hook-type engaging member is affixed to the support member.

37. The materials handling system of claim 34 further comprising a cross member interposed between and associated with each of said vertical engaging members.

38. The materials handling system of claim 1, wherein the container further comprises a horizontal engaging member associated with a member selected from the group consisting of the rear wall, the base of the container in an area adjacent the rear wall of the container, and combinations thereof.

39. The materials handling system of claim 38, wherein the horizontal engaging member is spaced downwardly from the base of the container by one or more vertical attachment members.

40. The materials handling system of claim 38, wherein the unloading station further comprises at least two vertical engaging members, each of said vertical engaging members further comprising a hook-type engaging member, wherein said hook-type engaging member is adapted to engage the horizontal engaging member of the container such that as the container is lowered by the bale, an upward force exerted on the horizontal engaging member by the vertical engaging members causes the container to rotate about the hook-type engaging members, thereby transferring materials contained within the container to the repository.

41. The materials handling system of claim 40, wherein at least one of the vertical engaging members further comprises a vertically extending portion which extends upwardly beyond the hook-type engaging member, wherein said vertically extending portion functions to guide and orient the container during transfer of materials from the container to the repository.

42. The materials handling system of claim 41 further comprising a support member extending transversely from the longitudinal axis of the vertical engaging member, wherein said hook-type engaging member is affixed to the support member.

43. The materials handling system of claim 43 further comprising a cross member interposed between and associated with each of said vertical engaging members.

* * * * *

UNITED STATES PATENT AND TRADEMARK OFFICE

CERTIFICATE OF CORRECTION

PATENT NO. : 6,371,718 B1
DATED : April 16, 2002
INVENTOR(S) : Harry L. Foster et al.

It is certified that error appears in the above-identified patent and that said Letters Patent is hereby corrected as shown below:

Column 19,
Line 28, replace "members" with -- member, --.

Column 20,
Line 35, replace "43" with -- 42 --.

Signed and Sealed this

Nineteenth Day of November, 2002

*Attest:*

*Attesting Officer*

JAMES E. ROGAN
*Director of the United States Patent and Trademark Office*